US006145972A

United States Patent [19]

Udagawa et al.

[11] Patent Number: 6,145,972

[45] **Date of Patent: *Nov. 14, 2000**

[54] CONTAINER FOR LIQUID TO BE EJECTED

[75] Inventors: Kenta Udagawa, Kawasaki; Hajime Kishida, Tokyo; Osamu Sato, Chigasaki; Ken Tsuchii, Sagamihara; Kazuhiro Nakajima, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/971,711

[22] Filed: Nov. 17, 1997

[30] Foreign Application Priority Data

| | | | |
|---|---|---|---|
| Nov. 15, 1996 | [JP] | Japan | 8-305347 |
| Apr. 25, 1997 | [JP] | Japan | 9-109869 |
| Apr. 28, 1997 | [JP] | Japan | 9-111143 |
| Nov. 7, 1997 | [JP] | Japan | 9-305572 |

[51] Int. Cl.[7] ..... B41J 2/175

[52] U.S. Cl. ..... 347/86

[58] Field of Search ..... 347/84, 85, 86, 347/87

[56] References Cited

U.S. PATENT DOCUMENTS

| | | | |
|---|---|---|---|
| 5,430,471 | 7/1995 | Nakajima et al. | 347/87 |
| 5,509,140 | 4/1996 | Koitabashi et al. | 347/86 |
| 5,583,549 | 12/1996 | Ujita et al. | 347/86 |
| 5,589,862 | 12/1996 | Ujita et al. | 347/87 |
| 5,635,961 | 6/1997 | Sato | 347/7 |

FOREIGN PATENT DOCUMENTS

| | | |
|---|---|---|
| 536980 | 4/1993 | European Pat. Off. . |
| 581531 | 2/1994 | European Pat. Off. . |
| 631874 | 1/1995 | European Pat. Off. . |
| 646465 | 4/1995 | European Pat. Off. . |
| 703083 | 3/1996 | European Pat. Off. . |
| 739741 | 10/1996 | European Pat. Off. . |
| 57-16385 | 1/1982 | Japan . |
| 5-104735 | 4/1993 | Japan . |
| 7-68778 | 3/1995 | Japan . |
| 7-125232 | 5/1995 | Japan . |

*Primary Examiner*—N. Le
*Assistant Examiner*—Anh T. N. Vo
*Attorney, Agent, or Firm*—Fitzpatrick, Cella, Harper & Scinto

[57] ABSTRACT

A container for containing liquid to be ejected. The container includes a negative pressure producing member accommodating chamber for accommodating a negative pressure producing member. The negative pressure producing member accommodating chamber is provided with an air vent for fluid communication with ambience and a liquid supply portion for supplying the liquid to a liquid ejecting head having ejection outlets. The container also includes a liquid containing chamber which is substantially hermetically sealed except for a fluid communication path through which the liquid containing chamber is in fluid communication with the negative pressure producing member accommodating chamber. A partition is provided for separating the negative pressure producing member accommodating chamber and the liquid containing chamber. The partition is provided with an ambience introduction path for introducing the ambience into the liquid containing chamber from the negative pressure producing member accommodating chamber. The ambience introduction path forms a capillary force generating portion. The capillary force which is produced by the capillary force generating portion satisfies a relationship between that capillary force and potential head differences, head losses, and other capillary forces in the container.

70 Claims, 19 Drawing Sheets

CONTAINER FOR LIQUID TO BE EJECTED

FIELD OF THE INVENTION AND RELATED ART

The present invention relates to a liquid accommodating container for liquid ejection, more particularly to a liquid accommodating container suitable to contain liquid ink or processing liquid usable with an ink jet recording apparatus.

Generally, an ink container is provided with an ink supply port for supplying the ink to an ink jet head and an air vent for introducing the volume of the air corresponding to the ink consumption into the ink container.

In such an ink container having two openings, it is desired that ink can be supplied stably to the ink jet head without discontinuity of the ink, that leakage of the ink is prevented under changes of the ambient condition when the recording operation is not carried out, and that leakage of the ink upon the unsealing at the time of exchange of the ink container can be assuredly prevented.

A patent application which has been assigned to the assignee of this application, proposes an ink accommodating container having a substantially hermetically sealed space for accommodating the liquid such as ink and a negative pressure producing chamber provided with a negative pressure producing member adjacent thereto to meet the desires.

The patent application is Japanese Laid-open Patent Application No. HEI-7-125232, U.S. Pat. No. 5,509,140, Japanese Laid-open Patent Application No. HEI-7-68778 or the like.

For example, Japanese Laid-open Patent Application No. HEI-7-125232 proposes that compression distribution is produced in the negative pressure producing member by insertion of the ink supply tube at a lateral side of the container so that ink in the sealing space is properly consumed.

Japanese Laid-open Patent Application No. HEI-7-125232 discloses an ink container comprising a negative pressure producing member accommodating chamber provided with an air vent and accommodating a negative pressure producing member, and a liquid containing chamber for directly accommodating the ink to be supplied to the negative pressure producing member accommodating chamber and in fluid communication with the negative pressure producing member accommodating chamber only through a small communicating portion provided at a position away from the air vent, by which the negative pressure property is stabilized, and the usage efficiency of the ink is increased. U.S. Pat. No. 5,509,140 discloses as an inner structure of the ink accommodating container having a gas-liquid exchange promoting structure by which the gas-liquid exchange can occur quickly, and the stabilized negative pressure zone is assured at an early stage.

Japanese Laid-open Patent Application No. HEI-7-68778 discloses a container wherein the ink supply is effected at a bottom portion of the ink accommodating container, and wherein the invention disclosed in said U.S. Pat. No. 5,509,140 is used, and a recess as temporary stagnation is formed in the bottom portion.

These inventions are employed in commercialized products of the assignee of this application. On the other hand, Japanese Utility Model Application No. SHO-57-16385 discloses a bird-feed (chicken-feed) type ink supply which is different from the inventions discussed above.

Recently, the demand for the ink jet recording apparatus is increasing, and the desire for the high speed and high quality recording is also increasing.

The use frequency of the ink jet recording apparatus increases, with the result of the increase of the consumption amount of the ink, and therefore, the ink container has to be exchanged more often, which is cumbersome for the user. Accordingly, an ink container having a large capacity is desired to reduce the exchange frequency of the ink container.

From the standpoint of high quality image, it is desirable to use ink having a large surface tension since then feathering of the ink on the recording material can be avoided.

The present invention is intended to provide a further improvement of a liquid container.

In the case that size of the container is large, the variation of the compressed state of the negative pressure producing member per se is large, with the possible result of the low yield.

On the other hand, a structure shown in FIG. 2 is known, wherein a member having a capillary force which is higher than that of the absorbing material disposed between the absorbing material and the supply port. An air vent C is formed in the upper wall B of the container A, and an ink supply port E is formed in the bottom wall D. An open cell member F is accommodated therein (single chamber). The entirety of the press-contact member G is within the container A, and it covers the ink supply port E.

The press-contact member is of a porous member having a density higher than that of the porous member or of a fiber bundle member or the like (press-contact member), and is pressed by a supply tube for supplying the liquid to the recording means such as a liquid ejection recording head. In order to permit this, press-contact member has a certain length in the pressing direction of the supply tube.

In this case, the porous member is pressed as shown in FIG. 22.

Japanese Laid-open Patent Application No. HEI-7-68778 discloses an ink container having a press-contact member and an ink supply port faced downward.

Japanese Laid-open Patent Application No. HEI-5-104735 discloses ink container having a press-contact member. With this structure, the press-contact member is disposed such that part thereof is projected outwardly of the ink container, and therefore, the entering or pressing degree relative to the negative pressure producing member (absorbing material) is smaller than the foregoing embodiment. Therefore, influence to the communicating portion by the pressing of the press-contact member to the negative pressure producing member is not so large as the previous example.

The present invention is directed to a further improvement.

SUMMARY OF THE INVENTION

Accordingly, it is a principal object of the present invention to provide a liquid accommodating container wherein stabilized negative pressure condition can be maintained, and the liquid in the substantially sealed space can be supplied out efficiently.

It is another object of the present invention to provide a liquid supply system using a stabilized state of a gas-liquid exchange structure.

It is a further object of the present invention to provide a relation under which a common structure is usable for the containers having different liquid supply amounts per unit time.

In this specification, "capillary force" means a height h(cmAq) of a liquid surface in a capillary tube from a predetermined liquid surface when the capillary tube is placed in liquid having the predetermined liquid surface; and "negative pressure" is a liquid internal pressure (−hcmAq) at the predetermined liquid surface position. In this specification, "ink" means liquid ink used in the ink jet recording apparatus and also the liquid for processing the ink in the recording.

According to an aspect of the present invention, there is provided a container for containing liquid to be ejected, comprising: a negative pressure producing member accommodating chamber for accommodating a negative pressure producing member, said negative pressure producing member accommodating chamber being provided with an air vent for fluid communication with ambience and a liquid supply portion for supplying the liquid to a liquid ejecting head; a liquid containing chamber substantially hermetically sealed except for a fluid communication path through which said liquid containing chamber is in fluid communication with said negative pressure producing member accommodating chamber; a partition for separating said negative pressure producing member accommodating chamber and said liquid containing chamber, said partition being provided with an ambience introduction path for introducing the ambience into said liquid containing chamber from said negative pressure producing member accommodating chamber, said ambience introduction path forming a capillary force generating portion; wherein the capillary force produced by said capillary force generating portion satisfies the following:

$$H<h\leqq H-Hp-\delta h$$

where h is a capillary force defined by dividing the capillary force generated by the capillary force generating portion by the density $\phi$ of the liquid to be ejected multiplied by the gravitational acceleration g (the dimension of h is length), that is, $h=\delta Pc/\phi g$, where $\delta Pc$ is the generated capillary force; H is a potential head difference between the capillary force generating portion and the liquid ejecting head plane including the ejection outlets; Hs is a capillary force defined by dividing the capillary force generated by the negative pressure producing member by the density $\phi$ of the liquid to be ejected multiplied by the gravitational acceleration g (the dimension of H is length), that is, $Hs=\delta Ps/\phi g$, where $\delta Ps$ is the capillary force of the negative pressure producing member; Hp is a potential head difference between the gas-liquid interface in the negative pressure producing member and the capillary force generating portion; $\delta h$ is head loss defined by dividing a pressure loss between the fluid communication path and the liquid supply opening through the negative pressure producing member by the density $\phi$ multiplied by the gravitational acceleration g (the dimension of $\delta h$ is length), that is, $\delta h=\delta Pe/\phi g$, where $\delta Pe$ is the pressure loss).

According to another aspect of the present invention, there is provided a container for containing liquid to be ejected, comprising: a negative pressure producing member accommodating chamber for accommodating a negative pressure producing member, said negative pressure producing member accommodating chamber being provided with an air vent for fluid communication with ambience and a liquid supply portion for supplying the liquid to a liquid ejecting head; a liquid containing chamber substantially hermetically sealed except for a fluid communication path through which said liquid containing chamber is in fluid communication with said negative pressure producing member accommodating chamber; a partition for separating said negative pressure producing member accommodating chamber and said liquid containing chamber,; said partition being provided with an ambience introduction path for introducing the ambience into said liquid containing chamber from said negative pressure producing member accommodating chamber, said ambience introduction path forming a capillary force generating portion;

wherein the capillary force produced by said capillary force generating portion satisfies the following:

$$H+hm<h\leqq Hs-Hp-\delta h$$

where h is a capillary force defined by dividing the capillary force generated by the capillary force generating portion by the density $\phi$ of the liquid to be ejected multiplied by the gravitational acceleration g (the dimension of h is length), that is, $h=\delta Pc/\phi g$, where $\delta Pc$ is the generated capillary force; H is a potential head difference between the capillary force generating portion and the liquid ejecting head plane including the ejection outlets; Hs is a capillary force defined by dividing the capillary force generated by the negative pressure producing member by the density $\phi$ of the liquid to be ejected multiplied by the gravitational acceleration g (the dimension of H is length), that is, $Hs=\delta Ps/\phi g$, where $\delta Ps$ is the capillary force of the negative pressure producing member; Hp is a potential head difference between the gas-liquid interface in the negative pressure producing member and the capillary force generating portion; $\delta h$ is head loss defined by dividing a pressure loss between the fluid communication path and the liquid supply opening through the negative pressure producing member by the density $\phi$ multiplied by the gravitational acceleration g (the dimension of $\delta h$ is length), that is, $\delta h=\delta Pe/\phi g$, where $\delta Pe$ is the pressure loss), wherein hm is a design margin capillary force divided by the density $\phi$ multiplied by the gravitational acceleration g (dimension is length), that is, $hm=\delta Pm/\phi g$, where $\delta Pm$ is a design margin capillary force.

According to further aspect of the present invention, there is provided a container for containing liquid to be ejected, comprising: a negative pressure producing member accommodating chamber for accommodating a negative pressure producing member, said negative pressure producing member accommodating chamber being provided with an air vent for fluid communication with ambience and a liquid supply portion for supplying the liquid to a liquid ejecting head; a liquid containing chamber substantially hermetically sealed except for a fluid communication path through which said liquid containing chamber is in fluid communication with said negative pressure producing member accommodating chamber; a partition for separating said negative pressure producing member accommodating chamber and said liquid containing chamber, wherein said partition is provided with a capillary force generating portion therein; a press-contact member in said liquid supply opening provided at a bottom side of said negative pressure producing member accommodating chamber, and an upper end surface of the press-contact member is contacted to said negative pressure producing member; wherein a distance $l_1$ from said fluid communication path to a portion of said press-contact member which is closest to said fluid communication path satisfies:

$$l_1<(Hs-Hpa-H)/\delta h$$

where h is a capillary force adjacent the fluid communication path defined by dividing the pressure by the density $\phi$ of the liquid to be ejected multiplied by the gravitational acceleration g (the dimension of h is length), that is, $h=\delta Pca/$ $\phi g$, where $\delta Pca$ is the pressure adjacent the fluid communication path; Hs is a capillary force defined by dividing the capillary force generated by the negative pressure producing member by the density $\phi$ of the liquid to be ejected multiplied by the gravitational acceleration g (the dimension of Hs is length), that is, $Hs=\delta Ps/\phi g$, where $\delta Ps$ is the capillary force of the negative pressure producing member; Hp is a potential head difference between the gas-liquid interface in the negative pressure producing member and the neighborhood of the fluid communication path; $\delta h$ is head loss defined by dividing a pressure loss between the fluid communication path and the liquid supply opening through the negative pressure producing member by the density $\phi$ multiplied by the gravitational acceleration g (the dimension of $\delta h$ is length), that is, $\delta h=\delta Pe/\phi g$, where $\delta Pe$ is the pressure loss).

According to further aspect of the present invention, there is provided a container for containing liquid to be ejected, comprising: a negative pressure producing member accommodating chamber for accommodating a negative pressure producing member, said negative pressure producing member accommodating chamber being provided with an air vent for fluid communication with ambience and a liquid supply portion for supplying the liquid to a liquid ejecting head; a liquid containing chamber substantially hermetically sealed except for a fluid communication path through which said liquid containing chamber is in fluid communication with said negative pressure producing member accommodating chamber; a partition for separating said negative pressure producing member accommodating chamber and said liquid containing chamber, said partition being provided with an ambience introduction path for providing a capillary force generating portion in said partition wall and for introducing ambience into said liquid containing chamber from said negative pressure producing member accommodating chamber; a press-contact member in said liquid supply opening provided at a bottom side of said negative pressure producing member accommodating chamber, and an upper end surface of the press-contact member is contacted to said negative pressure producing member; wherein a distance $l_1$ from said fluid communication path to a portion of said press-contact member which is closest to said fluid communication path;

$$l_1<(Hs-Hp-h)/\delta h$$

where h is a capillary force adjacent the fluid communication path defined by dividing the pressure by the density $\phi$ of the liquid to be ejected multiplied by the gravitational acceleration g (the dimension of h is length), that is, $h=\delta Pc/\phi g$, where $\delta Pc$ is the pressure adjacent the fluid communication path; Hs is a capillary force defined by dividing the capillary force generated by the negative pressure producing member by the density $\phi$ of the liquid to be ejected multiplied by the gravitational acceleration g (the dimension of Hs is length), that is, $Hs=\delta Ps/\phi g$, where $\delta Ps$ is the capillary force of the negative pressure producing member; Hp is a potential head difference between the gas-liquid interface in the negative pressure producing member and the neighborhood of the fluid communication path; $\delta h$ is head loss defined by dividing a pressure loss between the fluid communication path and the liquid supply opening through the negative pressure producing member by the density $\phi$ multiplied by the gravitational acceleration g (the dimension of $\delta h$ is length), that is, $\delta h=\delta Pe/\phi g$, where $\delta Pe$ is the pressure loss).

According to an aspect of the present invention, when the liquid is filled, the liquid containing chamber contains only the liquid, and in the negative pressure producing member in the negative pressure producing member accommodating chamber, the liquid is contained up to a predetermined height (gas-liquid interface position). With the consumption of the liquid through the liquid supply opening, the gas-liquid interface lowers. When the gas-liquid interface reaches the upper end of the ambience introduction path, having a capillary force generating portion, for introducing the ambience into the liquid containing chamber from the negative pressure producing member accommodating chamber, the ambience is introduced into the ambience introduction path. Then, the ambience enters the liquid containing chamber through the fluid communication path against the capillary force provided by the capillary force generating portion constituted in the ambience introduction path. Then, the liquid in the liquid containing chamber is supplied into the negative pressure producing member accommodating chamber(gas-liquid exchange). As a result, the liquid is again filled into the capillary force generating portion of the ambience introduction path, and capillary force is produced to stop the liquid supply from the liquid containing chamber.

In most of the part of the liquid consumption duration, the gas-liquid exchange is repeated, and the generated negative pressure in the negative pressure producing member is determined by the capillary force of the capillary force generating portion of the ambience introduction path. Therefore, by properly selecting the capillary force, the generated negative pressure can be controlled constant, and therefore, the negative pressure property is stabilized.

BRIEF DESCRIPTION OF THE DRAWINGS

FIGS. 1(A)–1(B) are a schematic perspective view showing an ink container and an integral head type container case according to an embodiment of the present invention, wherein FIG. 1(A) shows a state before the mounting, and FIG. 1(B) shows a state after the mounting.

DESCRIPTION OF THE PREFERRED EMBODIMENTS

Referring to the accompanying drawings, the embodiments of the present invention will be described.

Figure 1:
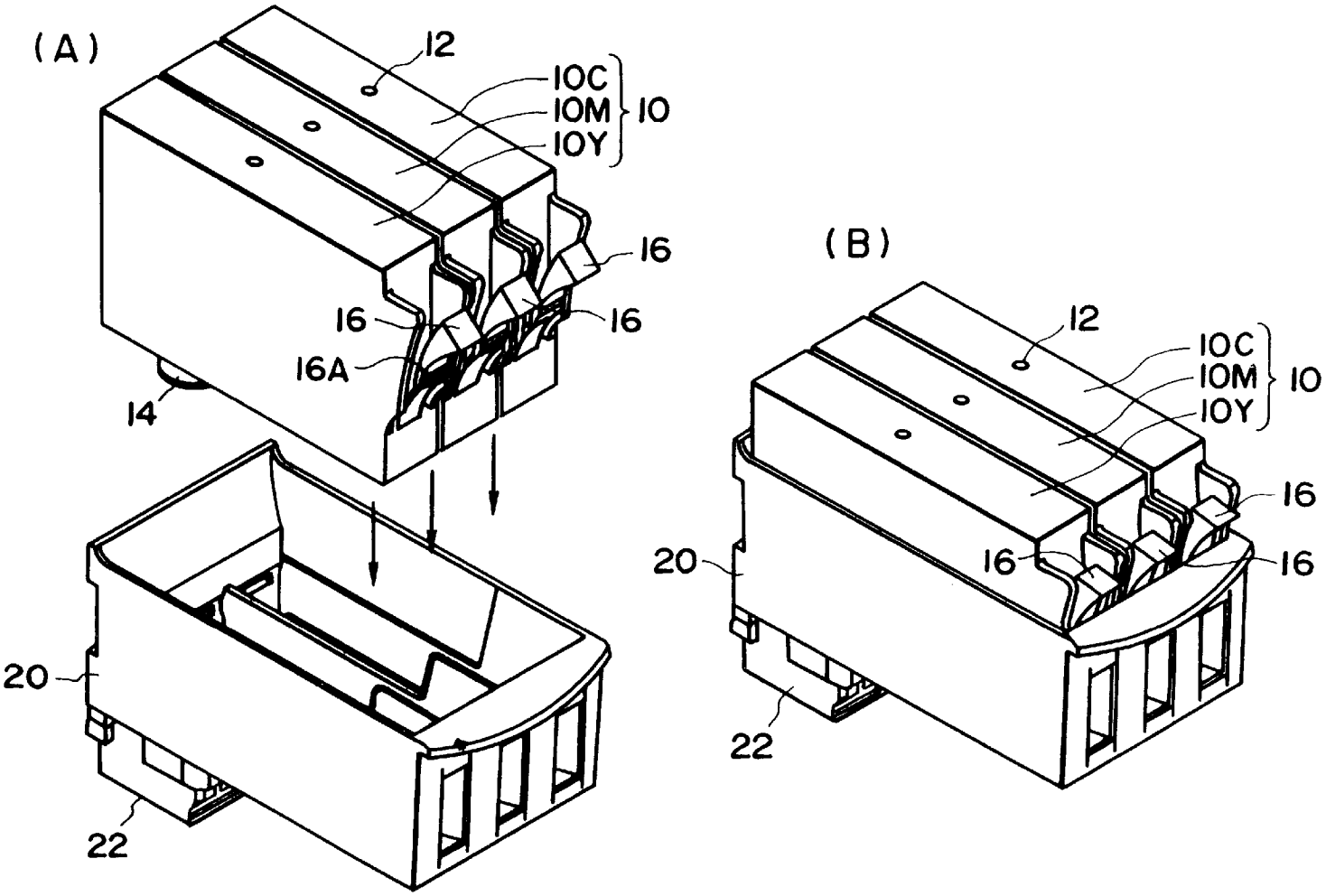
Figure 2:
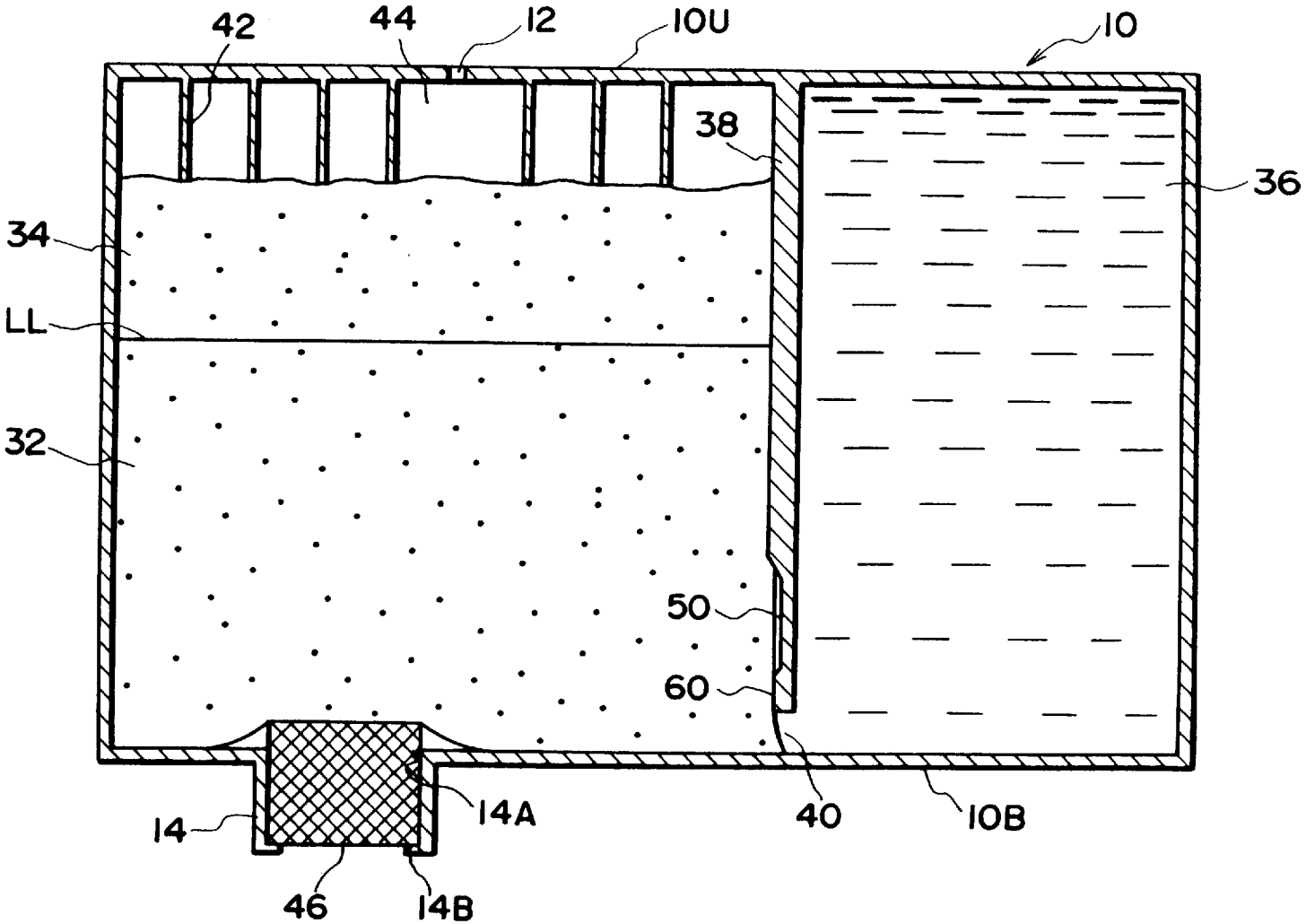
FIG. 2 is a sectional view showing an ink container according to an embodiment of the present invention.

Referring to FIGS. 1 and 2, the description will be made as to a first embodiment of the present invention.

An ink container 10 as a liquid accommodating container for liquid ejection according to this embodiment, is rectangular parallelopiped shape, and has an upper wall 10U provided with an air vent 12 for fluid communication between the inside of the ink container and the ambience.

Figure 13:
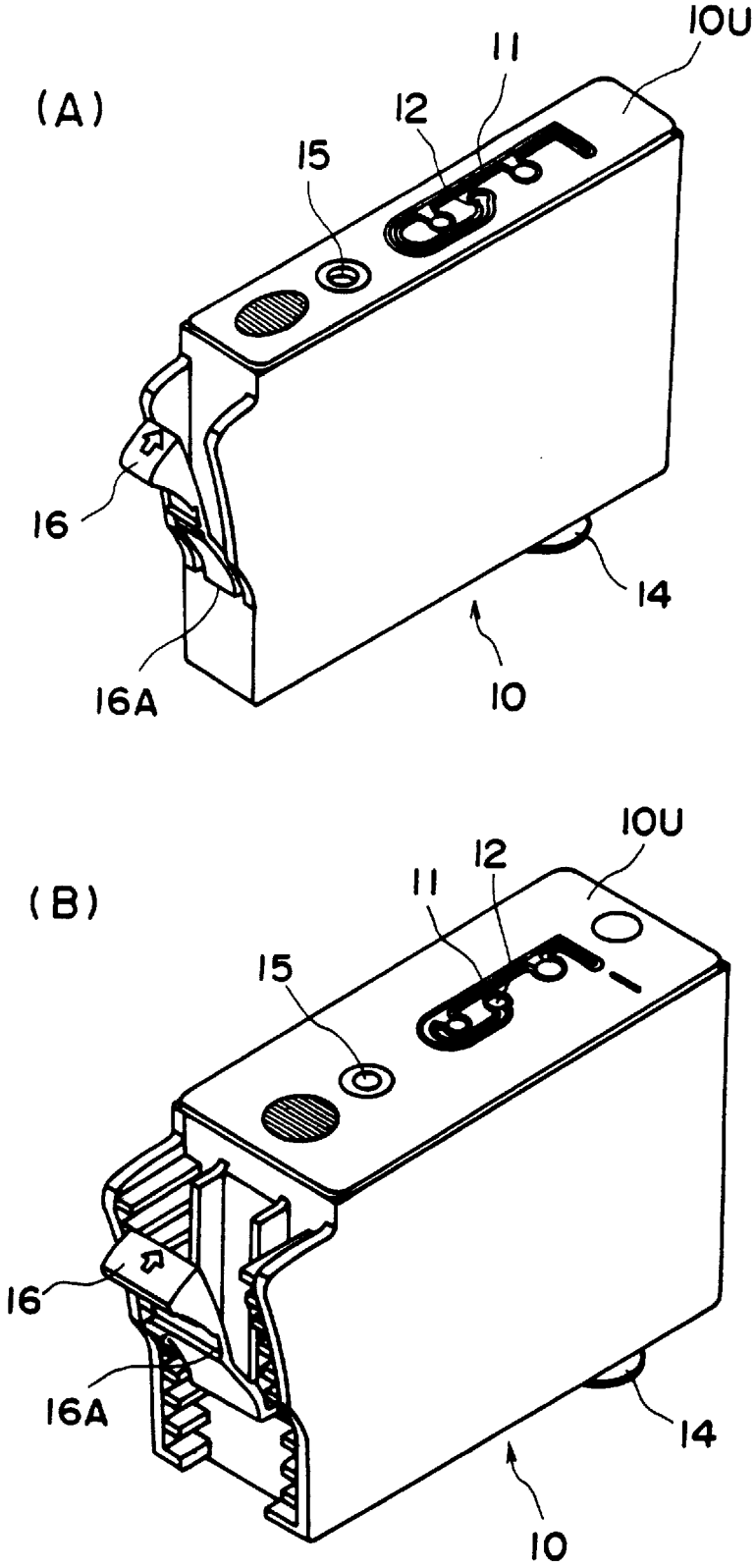
FIGS. 13(A)–13(B) are a perspective view of an ink container according to a further embodiment of the present invention.

The air vent 12 has a diameter of 1 mm approx. usually, when it is formed by injection molding. Since the evaporation of the ink is a kind of scattering phenomenon, and therefore, it increases in proportional to scattering passing, and decreases proportionally to 2power of the scattering distance. As shown in FIGS. 13, (A) and (B), a groove extending to the portion of the air vent 12 is formed in the upper wall 10U, and the groove is zigzag-shaped or labyrinth groove to function as an air venting groove 11.

A film member (unshown) is mounted on the upper wall 10U of the ink container 10 by welding, by adhesive material or by adhesive material to cover the long complicated air venting groove 11, by which a long complicated air venting passage is constituted. By doing so, the evaporation amount of the ink can be reduced to $1/1000$–$1/10000$ as compared with directly opening the air vent 12 to the ambience. FIG. 13, (B) shows an outer appearance of a container for black ink for example which is large in amount of consumption.

A part of the film member is extended beyond the end surface of the ink container 10 to function as a picking portion. The picking portion is provided with a mark indicating that it is a picking portion. The film member is provided with a partial cut to assist removal at a portion off the air venting groove 11, and by cutting the film member along the partial cut, an end of the air venting groove 11 is exposed or unsealed to permit fluid communication with the ambience, thus opening the air vent 12. In FIG. 1, only the air vent 12 is shown in the wall 10U for simplicity.

The lower wall 10B of the ink container 10 is provided with an ink supply cylinder 14 including an ink supply port as a liquid supply opening for delivery of the liquid, in the form of a projected cylindrical portion. In the distribution process of the commercial container, the air vent 12 is sealed by film or the like, and the ink supply cylinder 14 is sealed by an ink supply port sealing member such as a cap. Designated by 16 is a lever member integrally molded with the ink container 10 at the outside thereof, and is elastically deformable. It is provided with a projection for locking at a middle portion thereof.

Designated by 20 is a container case integral with the printing head and receives the ink container 10. The lower portion of the container case 20 is provided with an integral color ink jet head 22. The color ink jet head 22 is provided with a plurality of ejection outlets which are faced downward (surface having the ejection outlets having the plurality of ejection outlets).

Figures 1A, 1B:
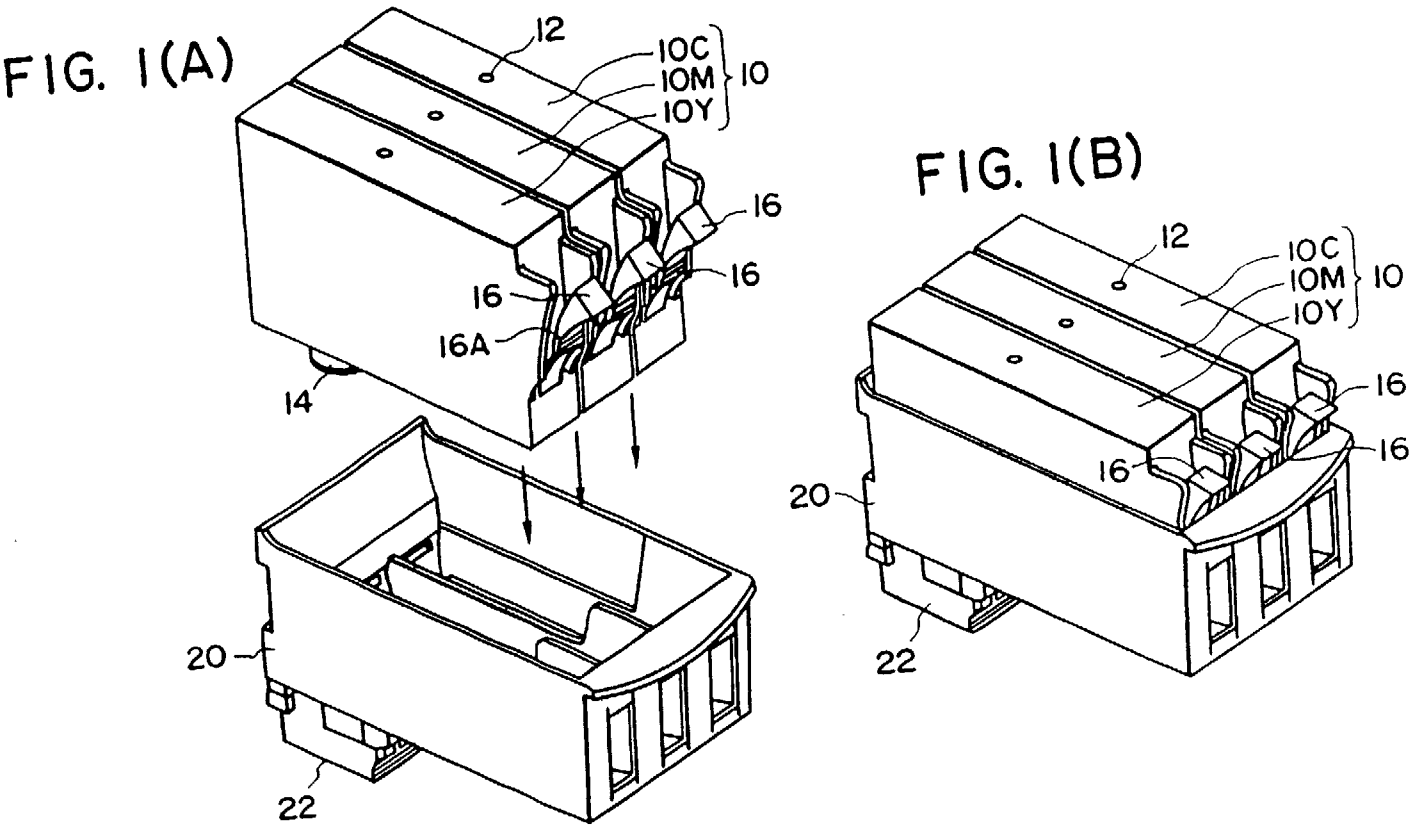

The ink container 10, taking the position shown in FIG. 1(A), is placed into integral head type container case 20, such that ink supply cylinder 14 is brought into engagement with an unshown ink supply cylinder receiving portion of the color ink jet head 22 and such that ink passage cylinder of the color ink jet head 22 enters the ink supply cylinder 14. Then, the locking projection 16A of the lever member 16 is engaged with an engaging portion formed at a predetermined position of the integral head type container case 20, so that regular mounting state shown in FIG. 1(B) is established. The integral head type container case 20 to which the ink container 10 is mounted, is carried on a carriage of the ink jet recording apparatus so that print-enabled state is established. With this state, a predetermined static head difference H is provided between the bottom portion of the ink container 10 and the plane including the ejection outlets of the printing head.

Referring to FIG. 2, the description will be made as to inner structures common to all embodiments of the ink container 10.

The ink container 10 is in fluid communication with the ambience through the air vent 12 at an upper portion thereof, and is in fluid communication with the ink supply port at a lower portion thereof. It comprises a negative pressure producing member accommodating chamber 34 for accommodating a liquid absorbing material 32 as a negative pressure producing member and a liquid containing chamber 36 substantially hermetically sealed to accommodate the liquid ink, the chambers being separated by a partition 38. The negative pressure producing member accommodating chamber 34 and the liquid containing chamber 36 are in fluid communication only through a fluid communication path 40 formed in the partition 38 adjacent the bottom portion of the ink container 10.

The upper wall 10U of the ink container 10 defining the negative pressure producing member accommodating chamber 34 is provided with a plurality of integrally molded ribs 42 which extends inwardly to contact the absorbing material 32 which is accommodated in the negative pressure producing member accommodating chamber 34 under a compressed state. Thus, an air buffer chamber 44 is formed between the wall 10U and the upper surface of the absorbing material 32. The absorbing material 32 is formed by heat-compressed urethane foam material, and is accommodated in the negative pressure producing member accommodating chamber 34 under the compressed state to generate predetermined capillary force as will be described hereinafter. The absolute value of the pore size of the absorbing material 32 for producing the predetermined capillary force is different depending upon materials of the ink to be used, dimensions of the ink container 10, the position of the plane including the ejection outlets of the ink jet head 22 (static head difference H) or the like. But, it is required to produce the capillary force which is larger than the capillary force in the capillary force generating groove or passage as a capillary force generating portion which will be described hereinafter, and therefore, the minimum limit thereof is desirably approx. 50/inch from this standpoint.

In the ink supply cylinder 14 defining the ink supply port 14A, a press-contact member 46 is disposed in the form of a disk or a column. The press-contact member 46 per se is of polypropylene or felt for example, and it is not readily deformable by external force. The press-contact member 46 is retained pressed in the absorbing material 32 for local compression of the absorbing material 32 thereby, when it is in the stated shown in FIG. 2 (not mounted in the container case 20). The end of the ink supply cylinder 14 is provided with a flange 14B contacted to the neighborhood of the press-contact member 46 to prevent disengagement thereof to the outside.

The amount of pressing is preferably 1.0–3.0 mm when the ink passage cylinder of the color ink jet head 22 is in the ink supply cylinder 14 and 0.5–2.0 mm when it is not therein. By this, the leakage of the ink can be prevented when the ink container is removed, while assuring the proper flow of the ink when it is mounted.

Since the ink supply port portion is provided with the press-contact member 46, which is pressed to the absorbing material 32, the portion of the absorbing material 32 contacted to the press-contact member 46 is deformed. Therefore, when the ink supply port 14A becomes too close to the fluid communication path 40 which is a gas-liquid exchange opening, the influence of the strain due to the deformation of the absorbing material 32 reaches the gas-liquid exchange opening, with the result that manufacturing variation of the ink container increases. In the worst case, no proper negative pressure can be generated with the result of ink leakage through the ink supply port 14A. On the contrary, when the ink supply port 14A is too far from the fluid communication path 40 which is the gas-liquid exchange opening, the flow resistance from the fluid communication path 40 to the ink supply port 14A is too larger during the gas-liquid exchanging operation which will be described hereinafter, with the result that ink discontinuity (stop) may occur due to the larger pressure loss when the ink consumption speed is high. Therefore, it is preferable that distance between the fluid communication path 40 and the end of the ink supply port 14A is 10–50 mm approx.

The description will be made as to a relation between the volumes of the negative pressure producing member accommodating chamber 34 and the liquid containing chamber 36. When a temperature change or a pressure change occurs during the use of the ink container 10 namely when the air is present at an upper portion of the liquid containing chamber 36, the air in the upper portion of the liquid containing chamber 36 expands with the possible result of discharge of the ink into the negative pressure producing member accommodating chamber 34. The ink thus discharged is absorbed by the absorbing material 32 in the negative pressure producing member accommodating chamber 34. Therefore, the volume of the absorbing material 32 is desirably determined so as to have enough absorption capacity for the ink discharged under all practical conditions.

In the case of large capacity ink container, the height of the absorbing material 32 is large (for example, not less than 40 mm), and therefore, the ink has to be sucked up against the gravity, and the absorption capacity is not simply determined by the volume. When the liquid level(gas-liquid interface) of the ink in the absorbing material 32 is high, the liquid level rising speed provided by the suction power of the absorbing material 32 against the gravity may not be enough with the result of leakage of the ink through the ink supply port. In order to suppress the liquid level rising speed, the bottom surface area of the negative pressure producing member accommodating chamber 34 is desirably large.

However, if the bottom surface area of the negative pressure producing member accommodating chamber 34 is made larger within a limited total volume, the volume of the negative pressure producing member accommodating chamber 34 becomes large so that volume of the liquid containing chamber 36 has to be small, and therefore, the ink amount capacity decreases.

On the other hand, the ink absorbing speed of the absorbing material 32 is influenced by the surface tension. When the surface tension Γ of the liquid is changed in the range of 30–50 (dyn/cm), it has been found that volume ratio between the negative pressure producing member accommodating chamber 34 and the liquid containing chamber 36 is approx. 1:1 to 5:3 for the temperature change of 5–35° C. which is normal condition, although it is dependent on the material of the liquid.

The size of the air buffer chamber 44 of the negative pressure producing member accommodating chamber 34 is desirably small from the standpoint of the volume efficiency. However, the capacity desirably assures the prevention of the ejection of the ink through the air vent 12 when the ink enters the negative pressure producing member accommodating chamber 34 abruptly. From this standpoint, the volume of the air buffer chamber 44 is desirably approx. ⅕–⅛ of the volume of the negative pressure producing member accommodating chamber 34.

The structure for controlling the negative pressure generated by the absorbing material 32 as the negative pressure producing member will be described.

Figure 10:
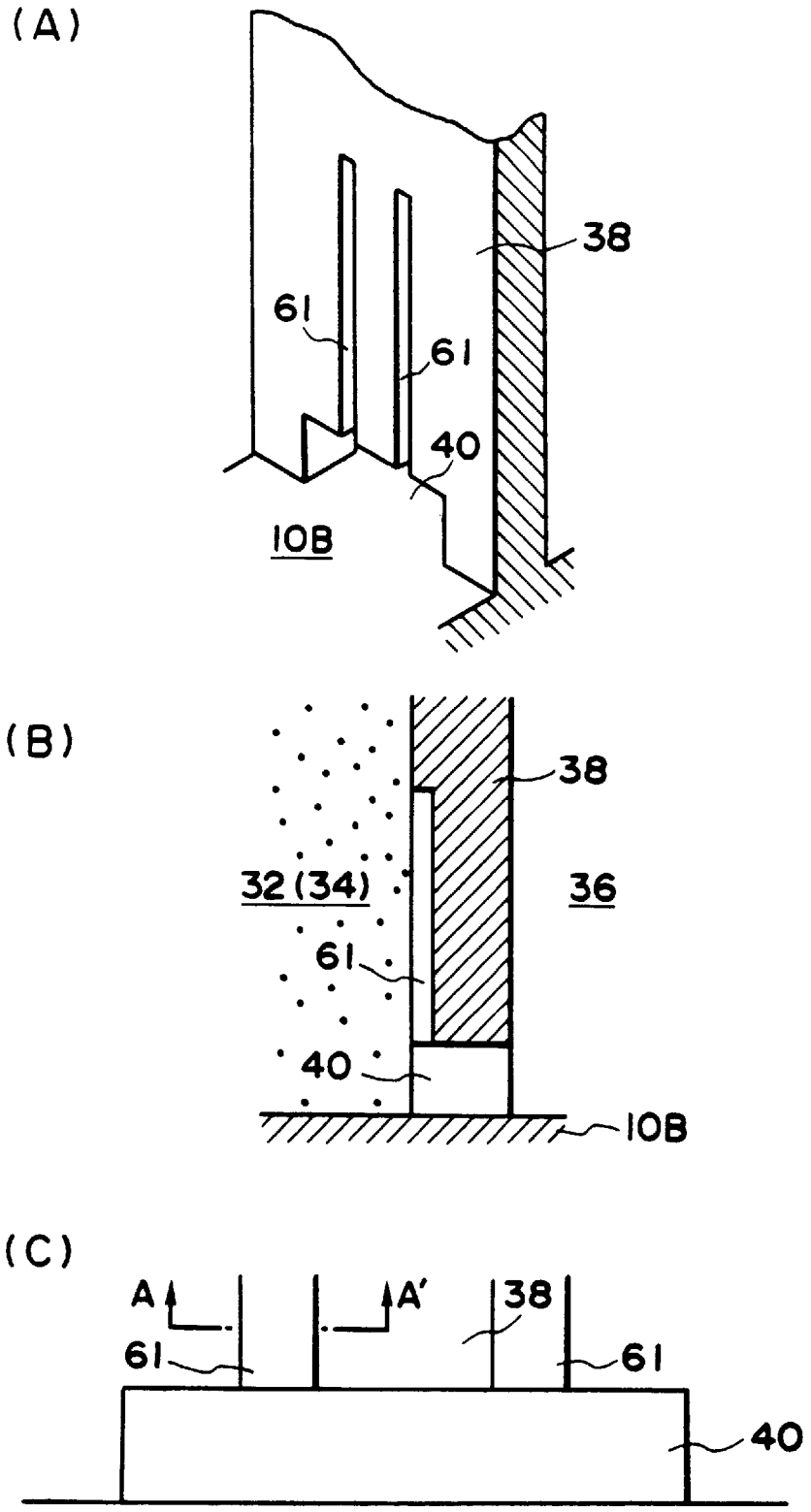
FIGS. 10(A)–10(C) are a schematic perspective view of FIG. 10(A) of a partition according to a further embodiment of the present invention, and a schematic sectional view of FIG. 10(B) thereof, and a schematic front view of FIG. 10(C) thereof.
Figure 10A:
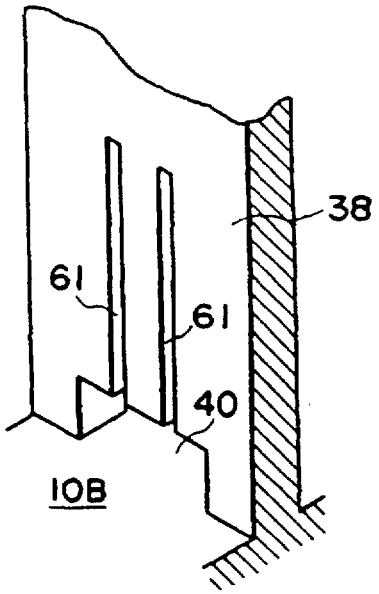
Figure 10B:
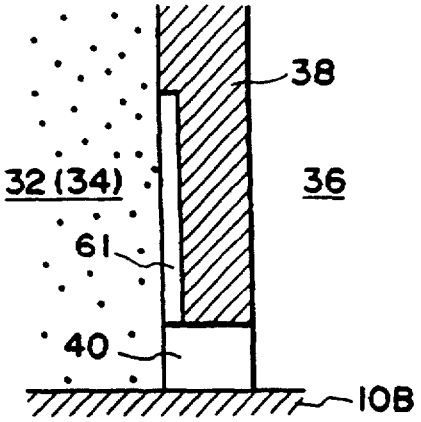
Figure 10C:
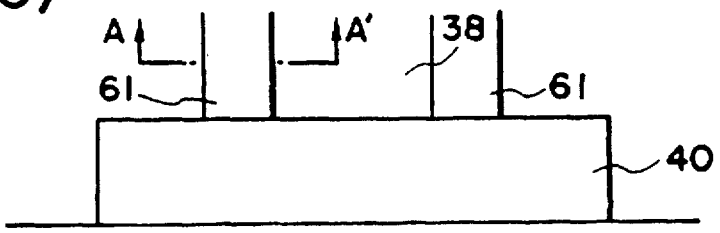

In a first example, as shown in FIGS. 10(A) to 10(C), two parallel passages 61 are formed at a negative pressure producing member accommodating chamber 34 side of the partition 38. The passages 61 are faced to the absorbing material 32 as the negative pressure producing member and form the capillary force generating portion of the ambience introduction path in fluid communication with the fluid communication path 40 at the bottom portion thereof. The passage 61 forming the capillary force generating portion can be deemed as capillary tubes, which produces capillary force, defined by the groove surfaces in the partition 38 and the side of the absorbing material 32, as will be described hereinafter.

Figure 11:
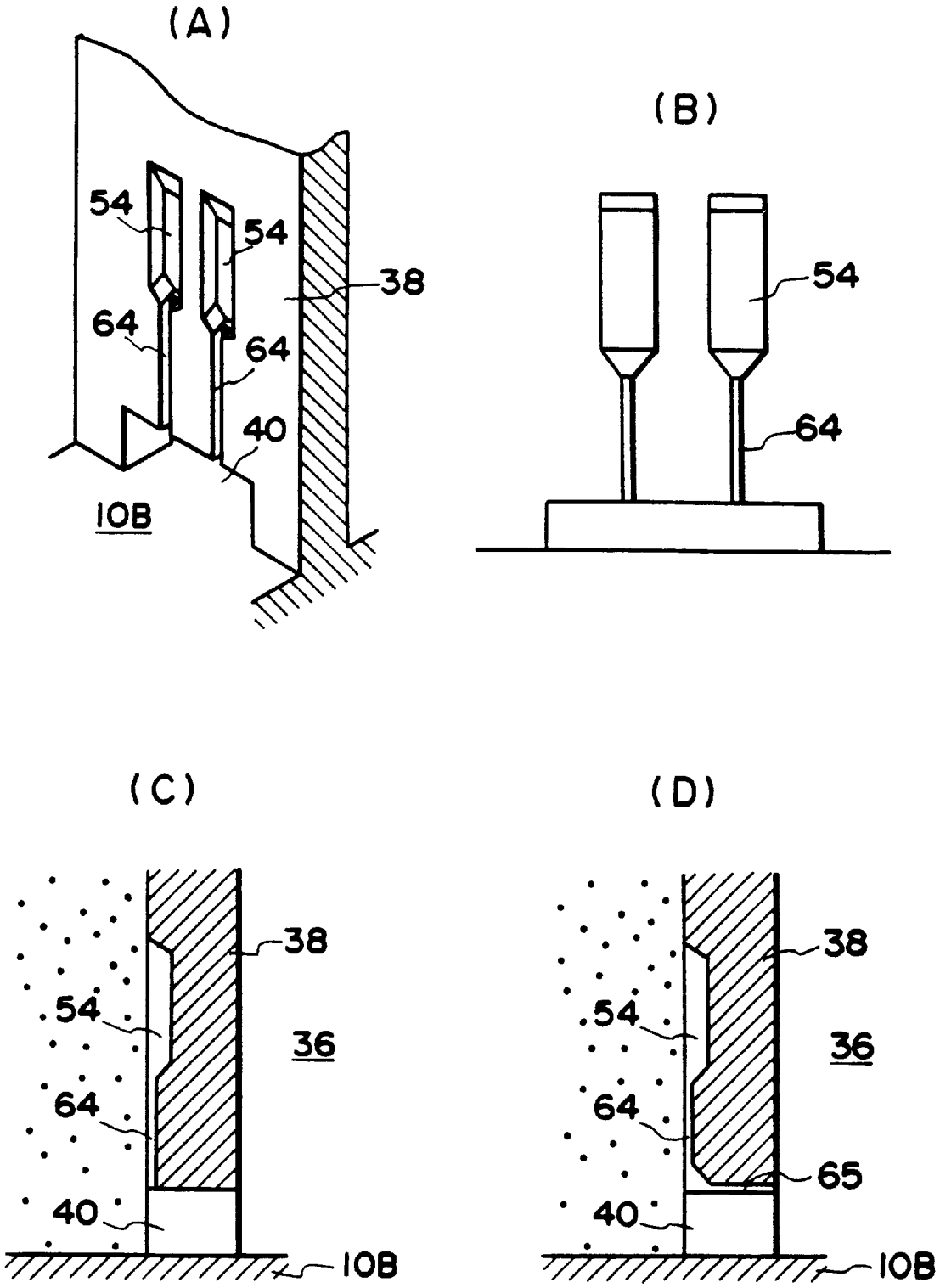
FIGS. 11(A)–11(D) are a schematic perspective view of FIG. 11(A) of a partition according to a further embodiment of the present invention, a front view of FIG. 11(B) thereof, schematic sectional view of FIG. 11(C) thereof, and a schematic sectional view of FIG. 11(D) of a partition according to a further embodiment.
Figure 11A:
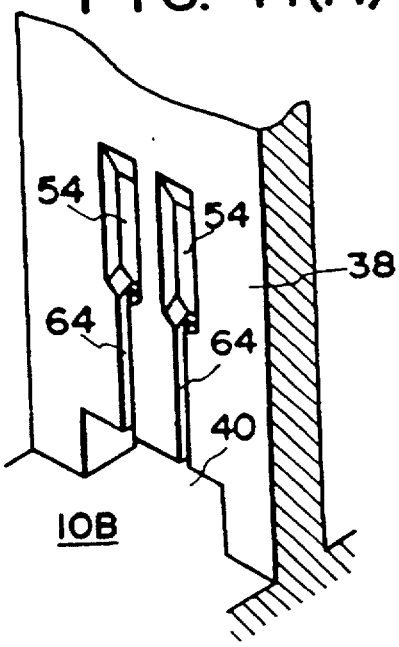
Figure 11B:
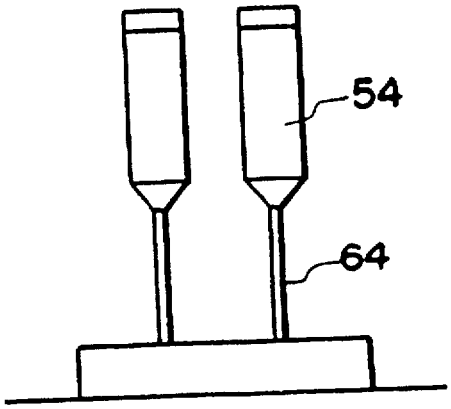
Figure 11C:
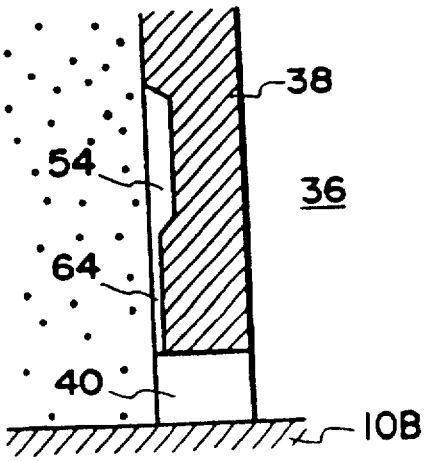
Figure 11D:
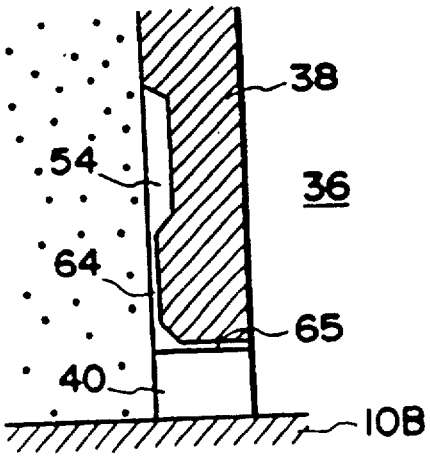

In a second example, as shown in FIGS. 11(A) to 11(D), there are formed, at the negative pressure producing member accommodating chamber 34 side of the bottom portion of the partition 38, first parallel passages 54 functioning as ambience introduction path having an open upper end contacted to the absorbing material 32 as the negative pressure producing member and second parallel passages 64 in fluid communication with the first passages 54 and in fluid communication with the fluid communication path 40 at the bottom portion. The ambience introduction groove is constituted by the first passage 54 and the second passage 64, and the second passage 64 has capillary force generating portions. The lower ends of the second passages 64 forming the capillary force generating portions, as shown in FIG. 11(D), may be continuous to the groove 65 extended in the longitudinal direction of the fluid communication path 40 at the top portion thereof. By doing so, the passage is assuredly formed even if the absorbing material 32 bulges into the groove at the lower end of the second passage 64. In this example, the first passage 54 is larger than the second passage 64, and therefore, the ambience introduction is assured, and the resistance upon the gas-liquid exchange start is reduced. The second passage 64, as will be described hereinafter, can be deemed as a capillary tube capable of producing the capillary force, defined by the groove surfaces of the partition 38 and the side of the absorbing material 32. In FIG. 11(D), there is provided a taper to promote passage of the air at the lower end of the second passage 64.

Figure 3:
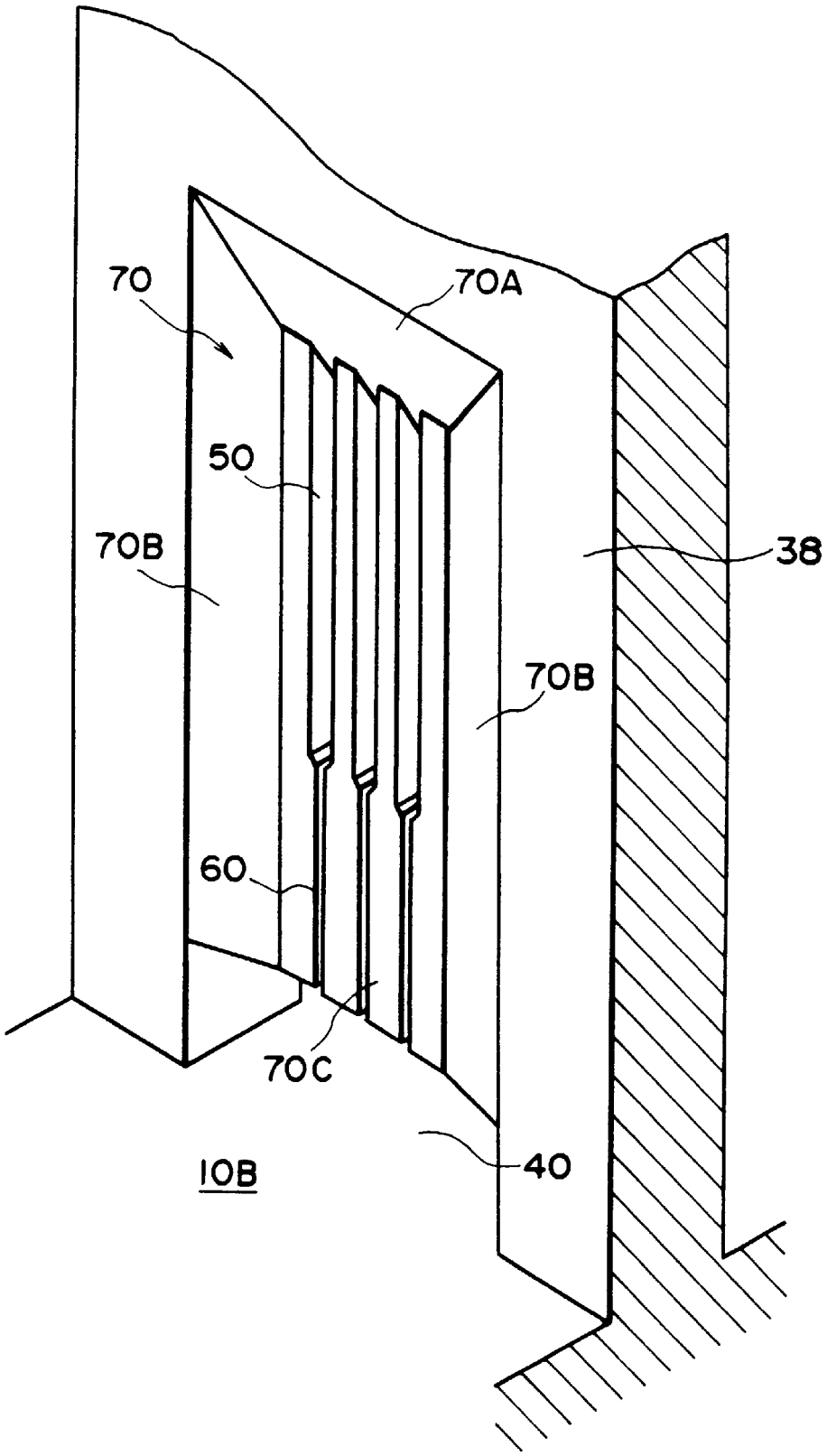
FIG. 3 is a perspective view showing a major part of the ink container of FIG. 2.

In a third type, as shown in FIG. 3, there are formed, at the negative pressure producing member accommodating chamber 34 side of the bottom portion of the partition 38, three first parallel passages 50 each having an open end contacted to the absorbing material 32 as the negative pressure producing member and three second parallel passages 60 in fluid communication with the fluid communication path 40 at the bottom end.

In this example, the first passages 50 and the second passages 60 which constitute the capillary force generating portion are formed in the bottom surface of the recess 70 formed in the center portion, in the lateral direction, of the partition 38. The 70 is formed by three surfaces 70A, 70B, 70B inclined at small angle relative to the surface of the partition 38 and a bottom surface 70C parallel to the surface of the partition 38. The width of the fluid communication path 40 is substantially equal to the width of the recess 70. The absorbing material 32 accommodated in the negative pressure producing member accommodating chamber 34 is press-contacted to the surface of the partition 38, the three surfaces 70A, 70B, 70B forming the recess 70 and the bottom surface 70C. The second passages 60 can be deemed as capillary tubes capable of producing capillary force and defined by the three surfaces in the partition 38 and the side of the absorbing material 32. In this example, the first passages 50 and the second passages 60 are formed in the bottom surface of the recess 70, and therefore, the ambience introduction is further stabilized so that gas-liquid exchange is further stabilized as compared with the other examples. Additionally, the structure of this example is effective to prevent stagnation of the air bubbles in the fluid communication path 40.

Figure 12:
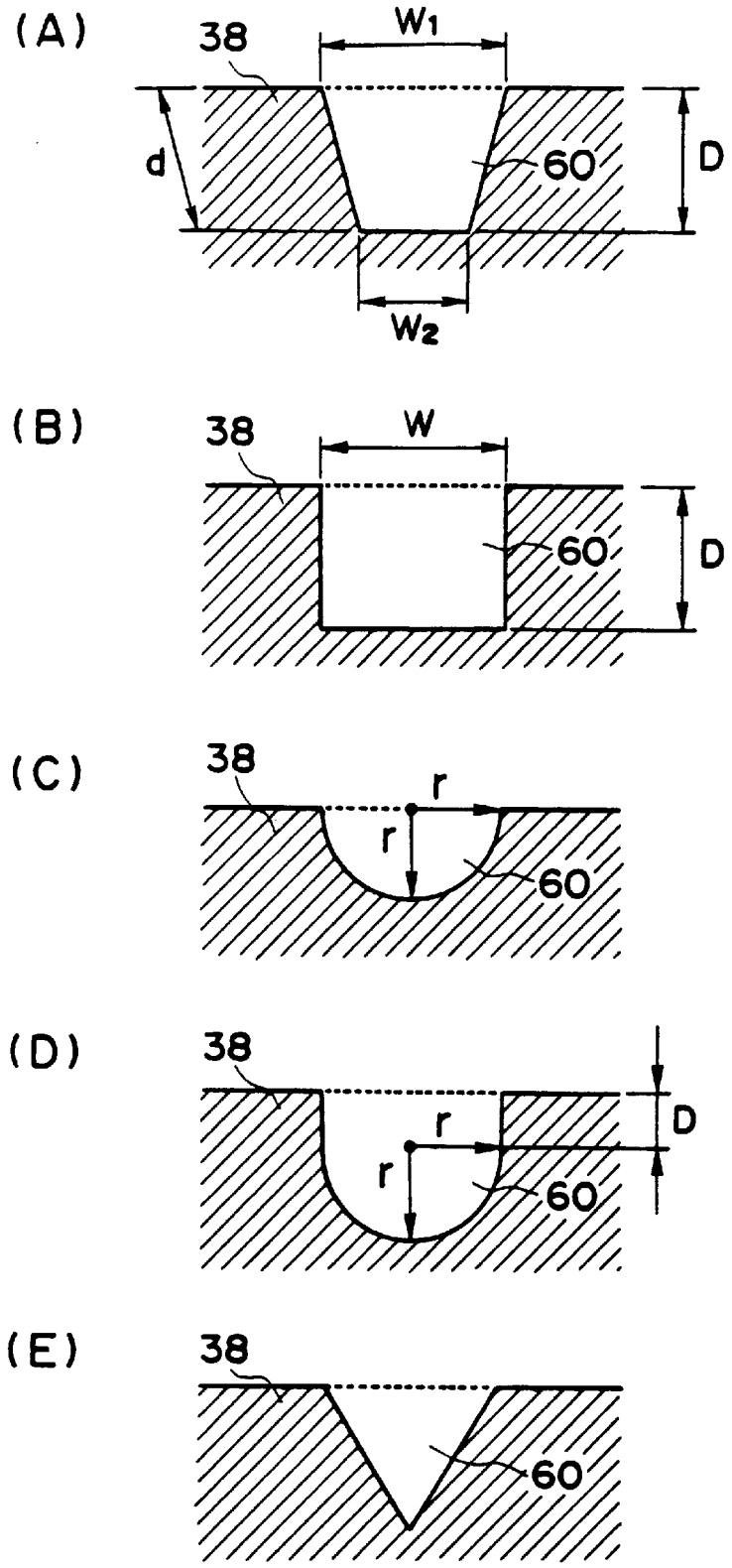
FIGS. 12(A)–12(E) are a schematic sectional view of a partition of various embodiments having capillary force generating portions of FIGS. 12(A)–(E).

Referring to FIG. 12, various examples of the cross-sectional configurations of the capillary force generating groove will be described.

Figure 12A:
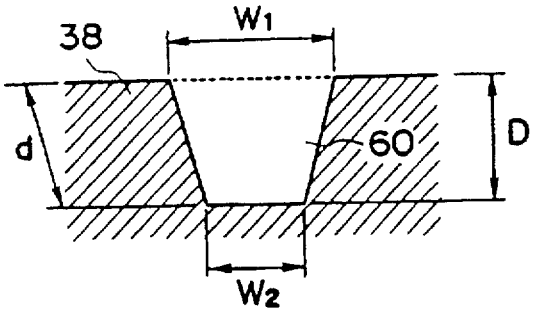

In the example shown in FIG. 12(A), the path has a trapezoidal section having a width of the opening W1, a width of the bottom portion W2, a depth (height) D and an inclined surface length(the inclination angle of the inclined surface is 1.3°) d. The circumferential length L is L=W1+W2+2d, and a cross-sectional area S is S=D (W1+2)/2.

Figure 12B:
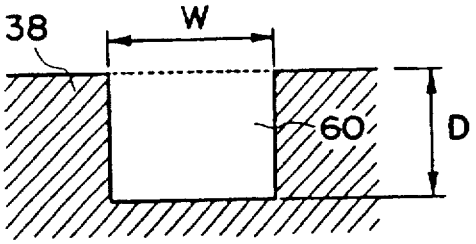

In an example shown in FIG. 12(B), it has a rectangular section having a width of the opening W, a depth (height) D. The circumferential length L is L=2 (W+D), and the cross-sectional area S is S=DW.

Figure 12C:
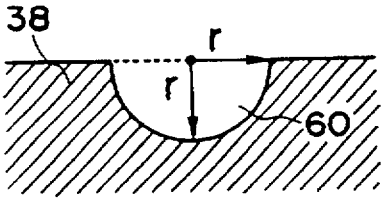

In an example shown in FIG. 12(C), it has a semicircular section having a width of the opening namely a diameter 2r. The circumferential length L is L=r (2+π), and the cross-sectional area S is $S=\pi r^2/2$.

Figure 12D:
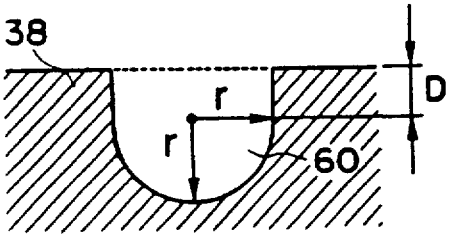
Figure 12E:
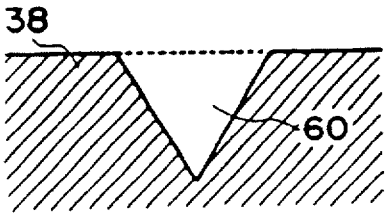

In an example shown in FIG. 12(D), it has a cross-section of a combination of a semicircular and a rectangular. FIG. 12(E) shows an example of triangular shape section. The circumferential lengths and the cross-sectional areas thereof are easily obtained, and therefore, are omitted.

Figure 4:
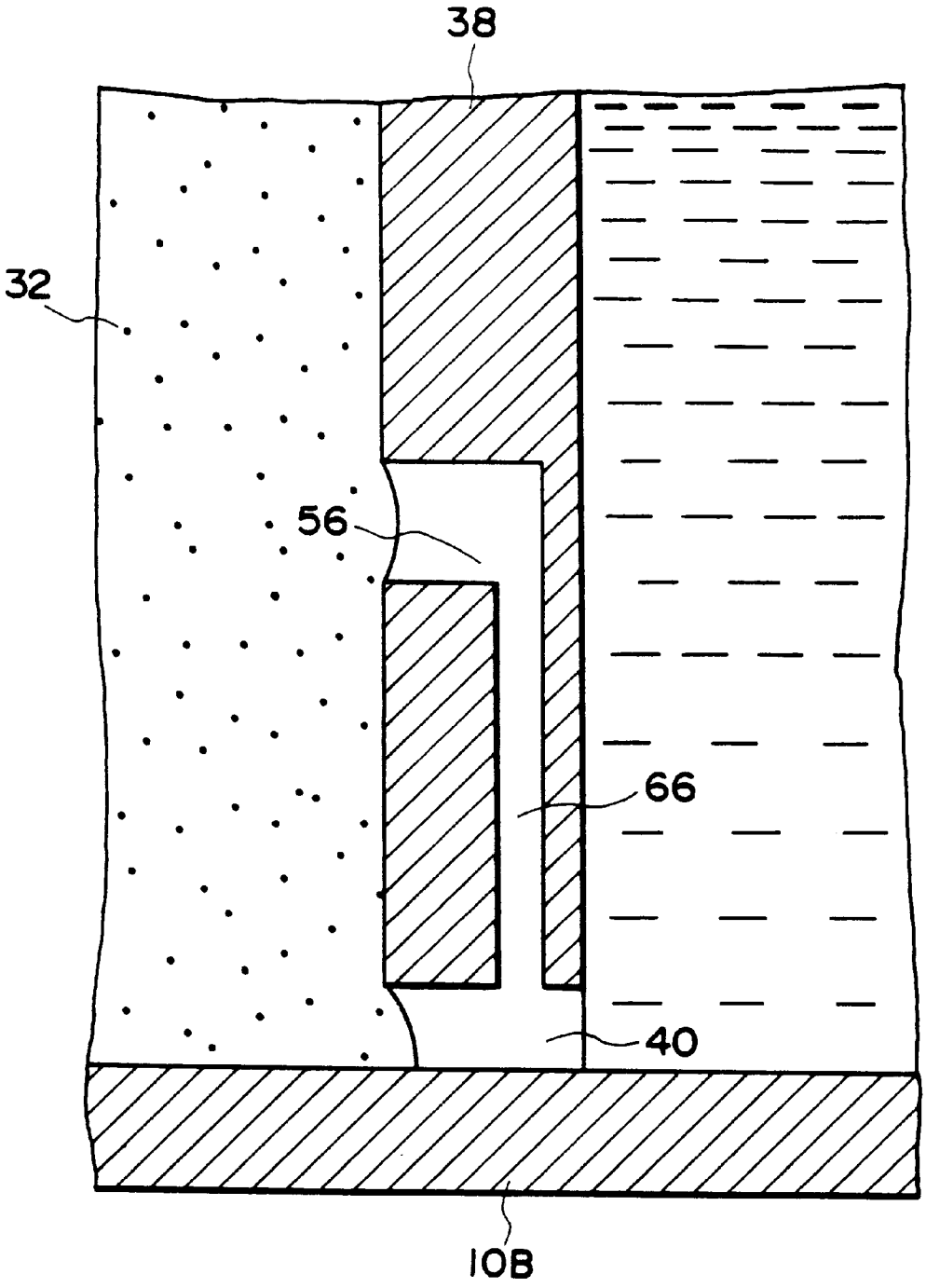
FIG. 4 is a sectional view showing a major part of an ink container according to a further embodiment of the present invention.

In these examples, the first and second passages are each in the form of a groove, but may be a closed passage as shown in FIG. 4. More particularly, at the end portion of the partition 38, there are provided an ambience introduction passage 56 as the first passage having an open end contacted to the absorbing material 32 as the negative pressure producing member and a capillary force generating passage 66 as the second passage in fluid communication with the ambience introduction passage 56 and in fluid communication with the fluid communication path 40 at the bottom end. By doing so, there is no need that capillary force generating passage 66 is constituted by the absorbing material 32 covering the part of the groove, and therefore, the capillary force generation can be produced without influence of the absorbing material 32.

Figure 14:
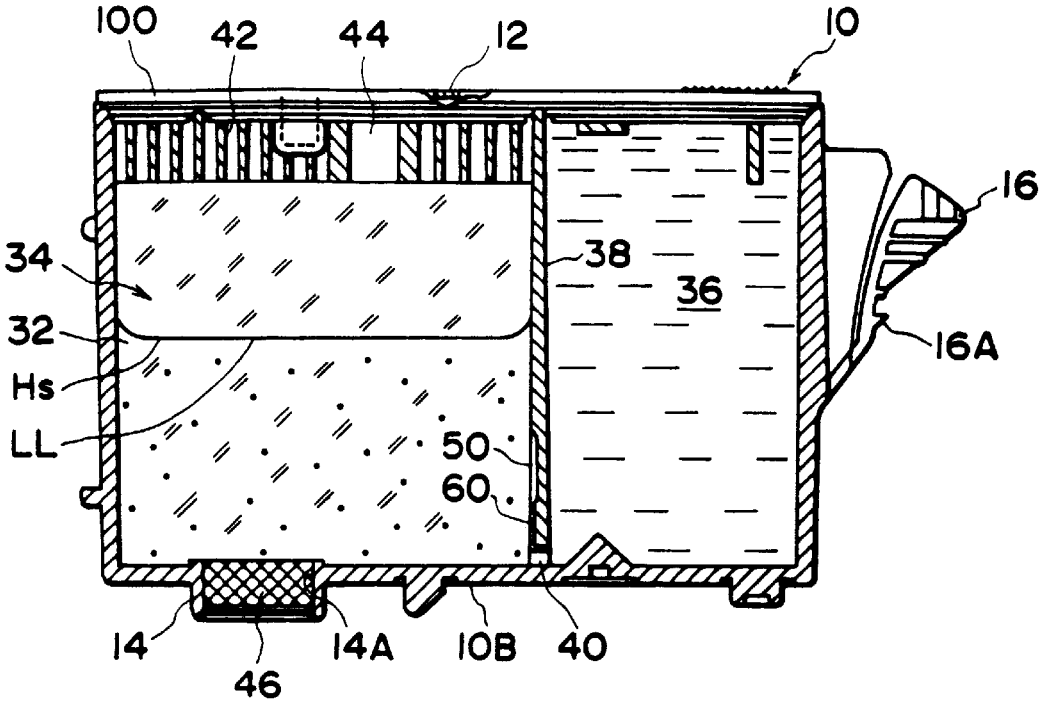
FIG. 14 is a sectional view of an ink container according to a further embodiment of the present invention, wherein capillary force Hs of the absorbing material is illustrated.
Figure 16:
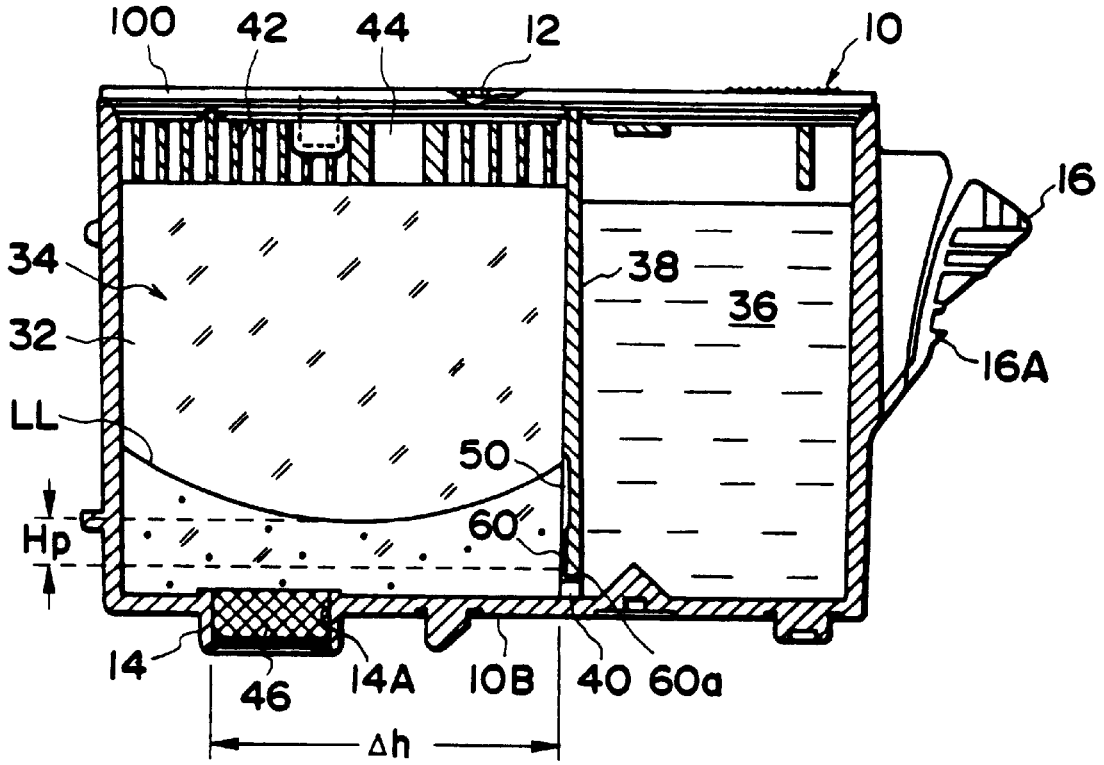
FIG. 16 is a sectional view of an ink container according to a further embodiment of the present invention, wherein static head difference Hp between a capillary force generating portion and a gas-liquid interface LL in another absorbing material and a pressure loss δh of the absorbing material upon the gas-liquid exchange, are illustrated.

Referring to FIGS. 14 and 16, the terms will be described before describing the operation of the ink container.

FIG. 14 shows the state in which the liquid containing chamber 36 is filled with the ink, wherein the ink has a gas-liquid interface LL provided by the capillary force of the absorbing material 32. The capillary force of the absorbing material Hs which is expressed by a capillary force of the absorbing material divided by an ink density ϕ multiplied by the gravitational acceleration g, thus having a dimension of length, is measured as a difference between the level of the gas-liquid interface LL before the gas-liquid exchange and the ambient pressure position # (level) in the liquid column continuous thereto.

Figure 15:
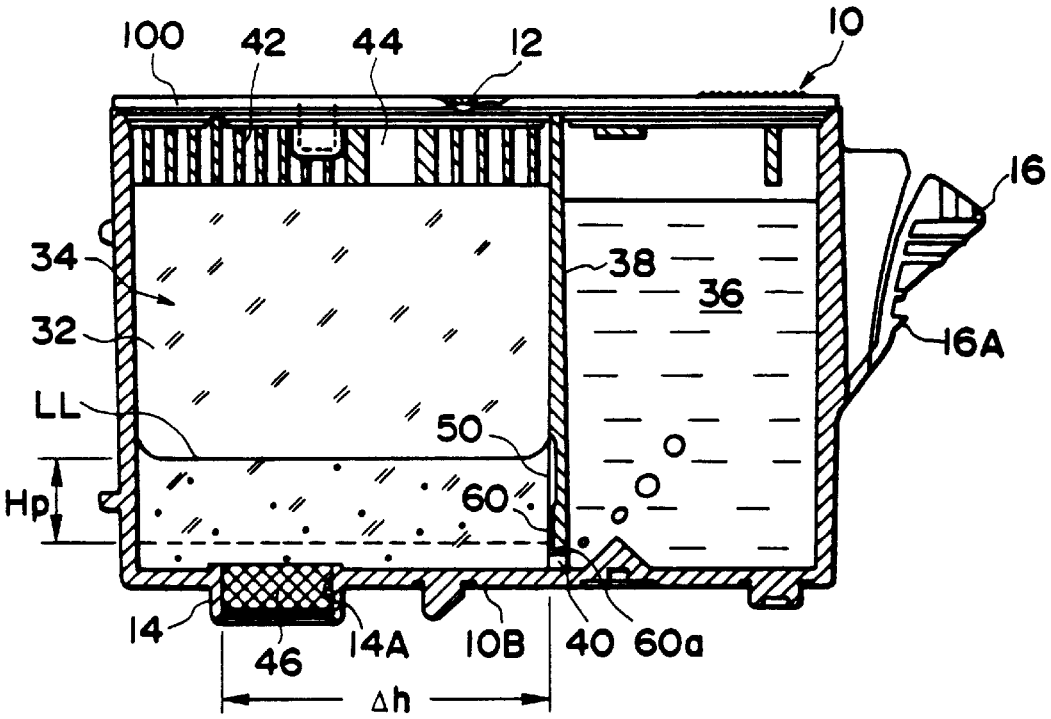
FIG. 15 is a sectional view of an ink container according to a further embodiment of the present invention, wherein a static head difference Hp between the capillary force generating portion and the gas-liquid interface LL in the absorbing material and a pressure loss δh of the absorbing material upon the gas-liquid exchange, are illustrated.

FIG. 15 show the state after the gas-liquid exchange starts as a result of the consumption of the ink, and Hp is a difference between the level of the gas-liquid interface LL in the absorbing material 32 as the negative pressure producing member and the capillary force generating portion 60*a* in the second passage 60 forming the capillary force generating portion. In the example of FIG. 15, a heat compressed absorbing material 32 is used. The absorbing material 32 has been subjected to a uniform heat compression, and then is inserted into the negative pressure producing member accommodating chamber 34, and therefore, the distribution of the compression ratio in the absorbing material 32 is quite uniform. Therefore, the gas-liquid interface LL in the absorbing material 32 is substantially horizontal, although the horizontal ends are slightly higher.

FIG. 16 shows a state after the gas-liquid exchange starts as a result of consumption of the ink. In this example, a non-compressed absorbing material 32 is used. An absorbing material having a volume quite larger than the volume of the negative pressure producing member accommodating chamber 34 is inserted with approx. 4–4.5 times compression(volume ratio), and therefore, the compression ratio distribution tends to be non-uniform. Therefore, the gas-liquid interface LL has a saw-teeth-like, but generally, the gas-liquid interface LL in the absorbing material 32 is concave-down shape (low in the middle and high at the end portions), as shown in the Figure. In this case, Hp is a difference in height between the bottommost point of the gas-liquid interface LL and the capillary force generating portion 60*a*.

In FIGS. 15 and 16, δh is a head loss expressed by a pressure loss in the absorbing material 32 as the negative pressure producing member between the fluid communication path 40 and the liquid supply opening 14A divided by an ink density ϕ multiplied by the gravitational acceleration g (thus having dimension of length). When the pressure loss is δPe, $\delta h = \delta Pe/\phi g$. The pressure loss is produced in the absorbing material 32, and therefore, it is a pressure loss between the end of the absorbing material 32 and the end of the liquid supply opening 14A as shown in the Figure. Since the pressure loss between the liquid containing chamber 36 and the fluid communication path 40 is substantially zero, the δh is measured by determining the difference between the pressure in the liquid containing chamber 36 and the pressure head at the end of the supply port 14A.

In the following description, the example having the first passage 50 and the second passage 60 as the ambience introduction path is taken, since the operations are the same as with the structure having only the capillary force generating groove and the structure having both of the ambience introduction passage 56 and the capillary force generating passage 66.

When the ink jet recording apparatus is operated, the ink is ejected from the ink jet head 22 so that ink suction force is produced in the ink container 10.

When the absorbing material 32 as the negative pressure producing member in the negative pressure producing member accommodating chamber 34 contains a sufficient amount of the ink, the ink in the negative pressure producing member is consumed, and therefore, the level of the upper surface of the ink (gas-liquid interface) (LL in FIG. 2) lowers. The generated negative pressure at this time is determined by the capillary force at the gas-liquid interface in the negative pressure producing member and the height of the gas-liquid interface LL measured from the plane including the ejection outlets.

With the consumption of the ink, the gas-liquid interface LL reaches the top end portion of the first passage 50 of the ambience introduction path. When the pressure at the bottom portion of the liquid containing chamber 36 becomes lower than that in the second passage 60, the ambience is supplied into the liquid containing chamber 36 through the first passage 50 and the second passage 60. As a result, the pressure in the liquid containing chamber 36 rises by the degree corresponding to the introduced air, and the ink is supplied into the absorbing material 32 from the liquid containing chamber 36 through the fluid communication path 40 to cancel the pressure difference between the raised pressure and the pressure in the absorbing material 32. Namely, the gas-liquid exchange is carried out. By this, the pressure at the bottom portion of the container rises by the degree corresponding to the ink supply amount, and the supply of the ambience into the liquid containing chamber 36 stops.

During the ink consumption, the gas-liquid exchange occurs continuously, so that ink is supplied into the negative pressure producing member accommodating chamber 34 from the liquid containing chamber 36, and therefore, the generated negative pressure during the ink consumption from the liquid containing chamber 36 is determinated by the capillary force generated in the second passage 60. Therefore, by properly selecting the dimensions of the second passage 60, the generated negative pressure during the ink consumption from the liquid containing chamber 36 can be determined.

Figure 5:
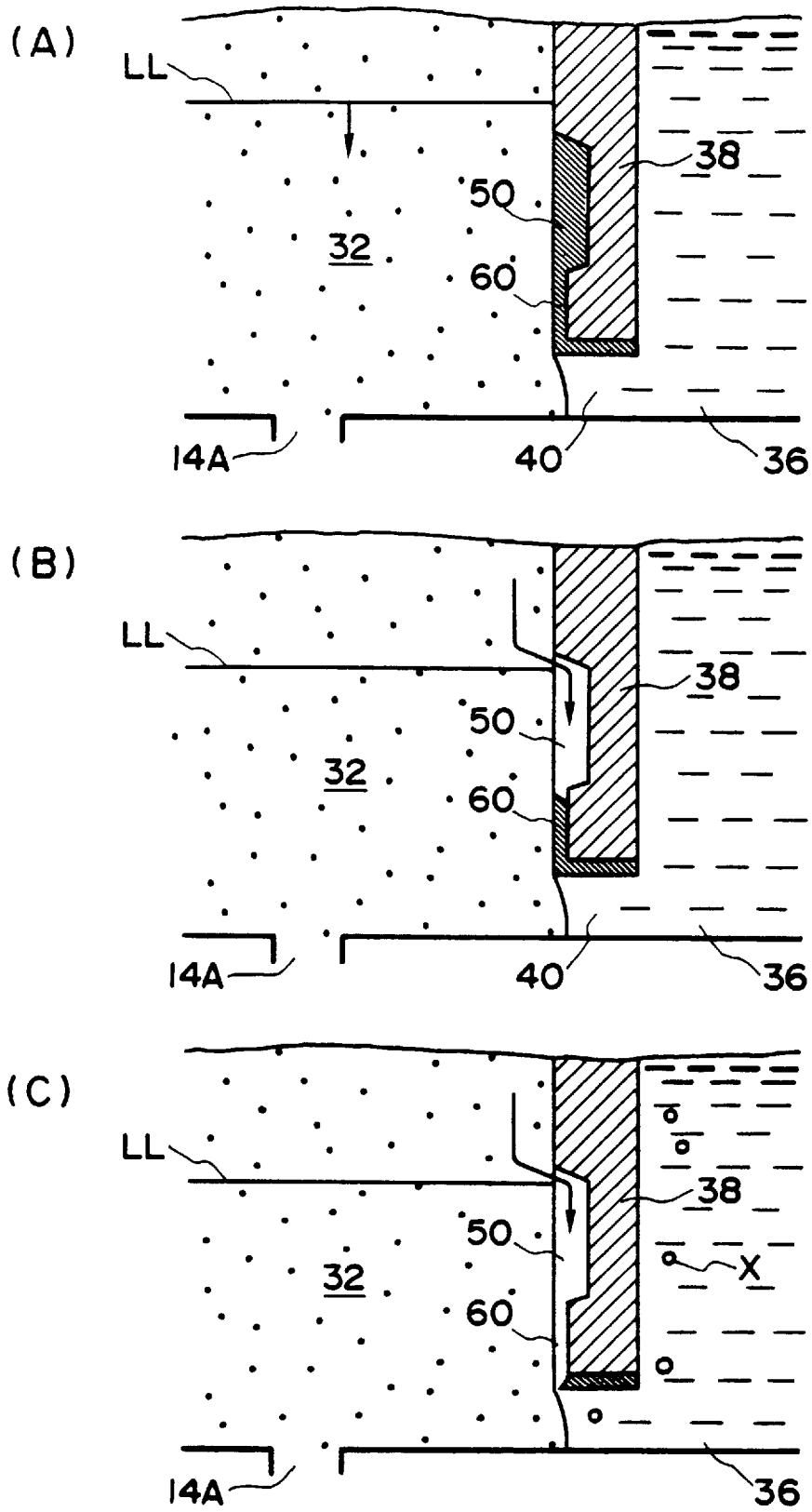
FIGS. 5(A)–5(C) are a schematic sectional view illustrating an operation of an ink container according to a present invention.

Referring to FIG. 5, the operation of the ink container 10 according to the present invention will be described.

The negative pressure producing member (absorbing material) 32 accommodated in the negative pressure producing member accommodating chamber 34 can be deemed as having a numerous capillary tubes, and the negative pressure is produced by the meniscus force thereby. Normally, the ink container 10, immediately after the start of use, contains a sufficient amount of the ink in the absorbing material 32 as the negative pressure producing member, and therefore, the static heads of the deemed capillary tubes are sufficiently high.

Figure 5A:
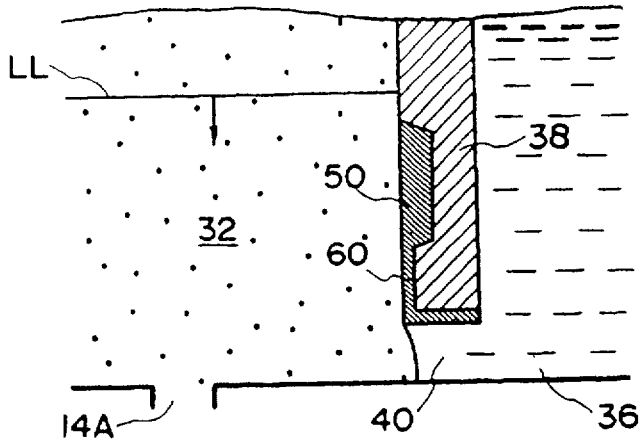

When the ink is consumed through the ink supply port 14A, the pressure at the bottom portion of the negative pressure producing member accommodating chamber 34 lowers, and therefore, the static heads of the deemed capillary tubes lower. More particularly, as shown in FIG. 5(A), the gas-liquid interface LL of the negative pressure producing member 32 lowers in accordance with the ink consumption. The static heads are not all equal, but the static heads of the deemed capillary tubes adjacent the ink supply port 14A are lower due to the pressure loss through the absorbing material 32.

The generated negative pressure in the ink container 10 at this time is determined by the capillary force of the negative pressure producing member 32, and the pressure at the plane including the ejection outlets of the ink jet head 22 is determined by the difference between the height of the gas-liquid interface LL and the height of the plane including the ejection outlets.

The hatched lines in the first passage 50 and the second passage 60 in FIG. 5, show the ink there for the purpose of illustration.

When the ink is further consumed, the gas-liquid interface LL lowers to the level shown in FIG. 5, (B) so that upper end of the first passage 50 of the ambience introduction path is above the gas-liquid interface LL, and the ambience enters the first passage 50. At this time, the capillary force produced in the second passage 60 as the capillary force generating portion is smaller than the capillary force of the deemed capillary tubes of the absorbing material 32, so that meniscus in the second passage 60 is broken by the further consumption of the ink, the ambient air X is introduced into the liquid containing chamber 36 through the second passage 60 and the fluid communication path 40 without lowering of the gas-liquid interface level LL, as shown in FIG. 5, (C).

When the ambient air X is introduced into the liquid containing chamber 36, the pressure of the liquid containing chamber 36 becomes higher than the pressure at the bottom portion of the negative pressure producing member accommodating chamber 34, and the ink is supplied into the negative pressure producing member accommodating chamber 34 from the liquid containing chamber 36 to compensate for the pressure difference. Then, the pressure becomes higher than the negative pressure generated in the second passage 60, and the ink flows into the second passage 60 to form the meniscus so that further introduction of the ambient air into the liquid containing chamber 36 stops.

When the ink is further consumed, the meniscus in the second passage 60 is broken again without lowering of the gas-liquid interface LL level, so that ambient air is introduced into the liquid containing chamber 36. Therefore, after the gas-liquid interface LL reaches the upper end of the first passage 50 of the ambience introduction path, the break and reformation of the meniscus in the second passage 60 are repeated during the consumption of the ink without lowering of the gas-liquid interface LL level, in other words, while maintaining the fluid communication between the ambience and the upper end of the ambience introduction path, so that negative pressure generated in the ink container 10 is controlled substantially at a constant level. The negative pressure is determinated by the force of the ambient air breaking the meniscus in the second passage 60, and as described above, is determined by the dimension of the second passage 60 and the property of the ink to be used (surface tension, contact angle and density).

Therefore, by determining the capillary force produced in the second passage 60 which is the capillary force generating portion to be between the lower limit value and the upper limit value of the capillary forces which may be different depending on the color and materials of the ink or the processing liquid in the liquid containing chamber, the ink containers 10 of the same structures can be used for all inks and processing liquid without change of the structure.

The pressure at the plane including the ejection outlets of the ink jet head 22 is determinated by a sum of the capillary force, the pressure loss of the absorbing material 32 and the relative height between the bottom portion of the ink container having the ink supply port 14A and the plane including the ejection outlets or the like.

The description will be made as to dimensional specifications of the second passages 60, 61, 64 and the second passages 62, 63 which will be described hereinafter.

As described hereinbefore, it is desirable that negative pressure generated in the ink container 10 is controlled at a constant level, in order to supply the ink without occurrence of ink discontinuity during the consumption of the ink. When the ink container 10 is mounted to the integral head type container case 20, and is carried on a carriage of the unshown ink jet recording apparatus # (print enabled state), a predetermined potential head difference is provided between the capillary force generating portion at the bottom portion of the ink container 10 and the plane including the ejection outlets of the head. In order to prevent leakage of the ink through the ejection outlet of the head with this state, the ink pressure in the ejection outlet in the plane including the ejection outlets is always lower than the ambient pressure.

Until the ink is used up from the liquid containing chamber 36, the height of the gas-liquid interface LL has to be maintained stably. To accomplish this, the meniscus at the gas-liquid interface LL in the absorbing material 32 should be maintained stably against the pressure loss generated by the flow of the ink through the absorbing material 32 during the ink consumption.

Therefore, it is desirable that capillary force produced by the capillary force generating portion satisfy:

$$H<h\leqq Hs-Hp-\delta h \quad (1)$$

Where h is a capillary force defined by dividing the capillary force generated by the capillary force generating portion by the density $\phi$ of the liquid to be ejected multiplied by the gravitational acceleration g (the dimension of h is length), that is, $h=\delta Pc/\phi g$, where $\delta Pc$ is the generated capillary force; H is a potential head difference between the capillary force generating portion and the liquid ejecting head plane including the ejection outlets; Hs is a capillary force defined by dividing the capillary force generated by the negative pressure producing member by the density $\phi$ of the liquid to be ejected multiplied by the gravitational acceleration g (the dimension of H is length), that is, $Hs=\delta Ps/\phi g$, where $\delta Ps$ is the capillary force of the negative pressure producing member; Hp is a potential head difference between the gas-liquid interface in the negative pressure producing member and the capillary force generating portion; $\delta h$ is head loss defined by dividing a pressure loss between the fluid communication path and the liquid supply opening through the negative pressure producing member by the density $\phi$ multiplied by the gravitational acceleration g (the dimension of $\delta h$ is length), that is, $\delta h=\delta Pe/\phi g$, where $\delta Pe$ is the pressure loss.

Generally, when the capillary force produced in the capillary tube is $\delta Pc$, the capillary force h converted to the dimension of length is expressed by:

$$h=L/S\times\Gamma/\phi g\times\cos\theta \quad (2)$$

Where L is the circumferential length (cm) of the tube; S is the cross-sectional area ($cm^2$); $\Gamma$ is the surface tension of the ink (dyn/cm); $\theta$ is the contact angle; $\phi$ is the density ($g/cm^3$); and g is the gravitational acceleration (980 $cm/^2$).

Therefore, the dimension of the capillary force generating portion is to satisfy the following by equations (1) and (2).

$$1/\cos\theta\times\phi g/\Gamma\times H<L/S\leqq 1/\cos\theta\times\phi g/\theta x(Hs-Hp-\delta h) \quad (3)$$

Where L is the circumferential length of the capillary force generating portion; S is the cross-sectional area; $\phi$ is the density of the ink; g is the gravitational acceleration; $\Gamma$ is the surface tension of the ink; and the $\theta$ is the contact angle of the ink.

In the actual use of the ink jet recording apparatus, accelerations due to various shocks or the scanning of the carriage, the temperature variation and the pressure variation due to the ambient condition change are imparted. Therefore, the ink pressure in the ejection outlet at the plane including the ejection outlets is preferably less than the ambient pressure by approx. −10 mm $H_2O$ including a safety factor.

Taking this into consideration, the capillary force h converted to length desirably satisfy the following:

$$H+hm<h\leqq Hs-Hp-\delta h \quad (4)$$

Therefore, (3) is:

$$1/\cos\theta\times\phi g/\theta\times(H+hm)<L/S\leqq 1/\cos\theta\times\phi g/\theta\times(Hs-Hp-\delta h)$$

Specific values will be given using as the example the second passage 60 having the trapezoidal section shown in FIG. 12(A).

EXAMPLE 1 the width of the opening W1=0.25 mm; the width of the bottom portion W2=0.24 mm; the depth D=0.38 mm. In this case, the inclined surface length # (the inclination angle of the inclined surface is 1.3°), d is approx. 0.38 mm, and L/S is 135 $cm^{-1}$. When the ink has a surface tension of 46.5 dyn/cm, the negative static pressure in the gas-liquid exchange was −5.2 cm. Therefore, when hm is 1 cm, H is 2.7 cm, Hs=10 cm, Hp=1.2 cm and δh=1.5 cm, then $96<L/S\leqq 189$ is satisfied.

EXAMPLE 2 the width of the opening W1=0.26 mm, the width of the bottom portion W2=0.25 mm, depth D=0.32 mm. In this case, the inclined surface length(the inclination angle of the inclined surface is 1.3°) d is approx. 0.32 mm, and L/S is 140 $cm^{-1}$. When the ink has a surface tension of 34.8 dyn/cm, the negative static pressure in the gas-liquid exchange was −4.9 cm. Therefore, when hm is 1 cm, H is 2.7 cm, Hs=10 cm, Hp=1.2 cm and δh=1.5 cm, then $106<L/S\leqq 209$ is satisfied.

EXAMPLE 3 the width of the opening W1=0.25 mm, the width of the bottom portion W2=0.23 mm, depth D=0.34 mm. In this case, the inclined surface length (the inclination angle of the inclined surface is 1.3°), and d is approx. 0.34 mm, and L/S is 143 $cm^{-1}$. When the ink has a surface tension of 41.6 dyn/cm, the negative static pressure in the gas-liquid exchange was −4.3 cm. Therefore, when hm is 1 cm, H is 2.7 cm, Hs=10 cm, Hp=1.2 cm and δh=1.5 cm, then $123<L/S\leqq 243$ is satisfied.

In order to produce necessary capillary force, the cross-sectional area (width×depth) of the second passage 60 is preferably approx. 0.20–0.40 mm ×0.20–0.40 mm, and in order to suppress the entering amount of the absorbing material 32 into the groove, it is preferable that width is smaller than the depth.

The cross-sectional area of the first passage 50 will suffice if it is larger than the cross-sectional area of the second passage 60. The length of the second passage 60 may be 2–10 mm approx. from the upper end of the fluid communication path 40. If it is too short, the press-contact of the absorbing material 32 is not stable, and if it is too long, the influence of the entering of the absorbing material 32 will be too significant, and therefore, about 4 mm is preferable.

The height of the upper end of the first passage 50 is effective to limit the height of the gas-liquid interface of the absorbing material 32, as described hereinbefore. Therefore, it is selected so that ink discontinuity does not occur, and so that buffering power of the absorbing material 32 is not deteriorated. Preferably, it is approx. 10–30 mm from the upper end of the fluid communication path 40.

Figure 6:
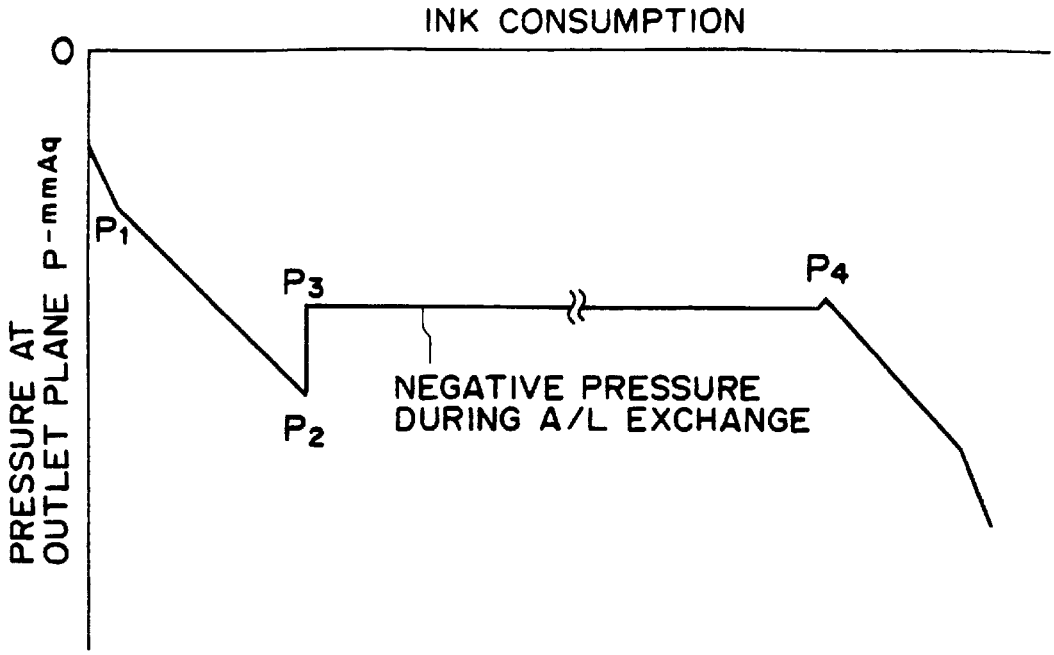
FIG. 6 is a graph showing a change of the generated negative pressure at the plane including the ejection outlets of the ink jet head relative to ink consumption, in an ink container according to an embodiment of the present invention.
Figure 7:
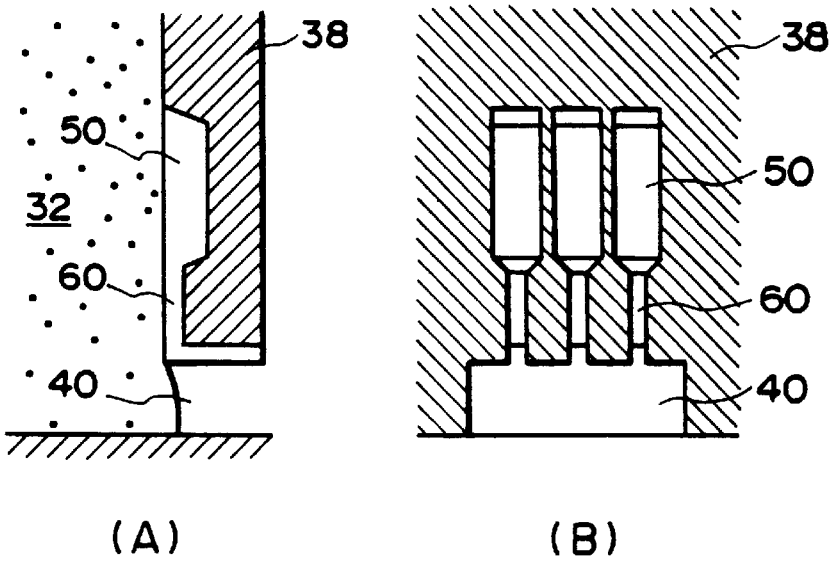
FIGS. 7(A)–7(B) are a schematic sectional view of FIG. 7(A) of a major part of the ink container of FIG. 2, and a schematic front view FIG. 7(B) of a partition.
Figure 8:
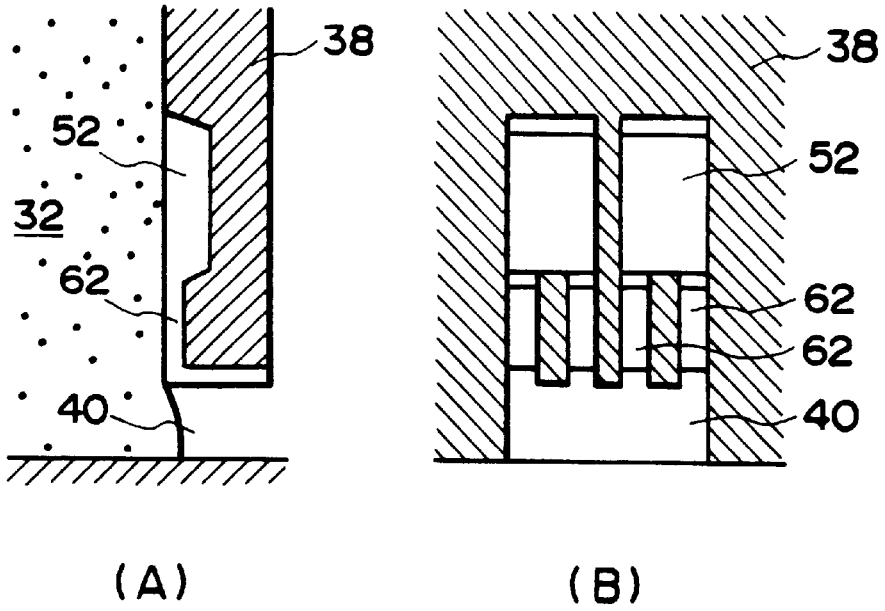
FIGS. 8(A)–8(B) are a schematic sectional view of FIG. 7(A) of a container according to a further embodiment of the present invention, and a schematic front view of FIG. 7(B) of a partition according to a further embodiment.

FIG. 6 shows the change of the pressure at the plane including the ejection outlets of the ink jet head 22 in accordance with the ink consumption. In the initial state immediately after the start of the use of the ink container 10, the meniscus of the absorbing material 32 is between the retracting contact angle and the advancing contact angle, and the negative pressure P1 generated by the retracting contact angle is reached after a small amount of ink consumption.

Thereafter, while the ink impregnated in the absorbing material 32 is consumed, that is, before the gas-liquid interface LL reaches the upper end of the first passage 50, the generated negative pressure is determinated by the capillary force of the absorbing material 32 and the static head difference between the gas-liquid interface LL and the ejection outlet. With the consumption of the ink, the negative pressure decrease until the gas-liquid interface LL reaches the upper end of the first passage 50 (the period from P1 to P2, corresponding to FIG. 5(A)).

Figure 5B:
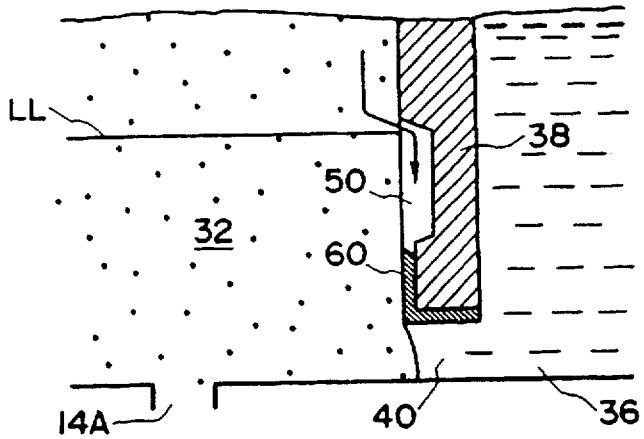
Figure 5C:
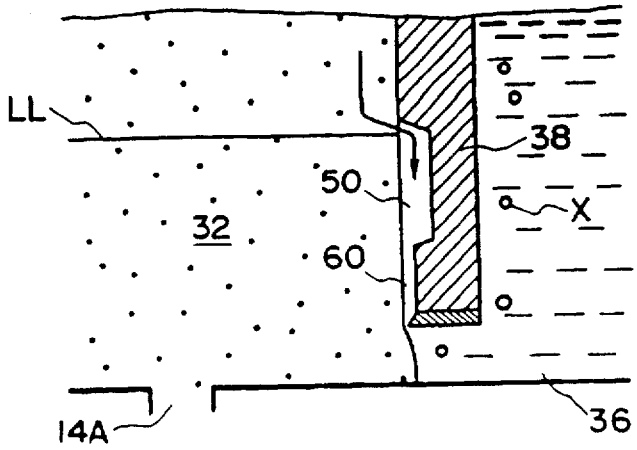
Figure 6:
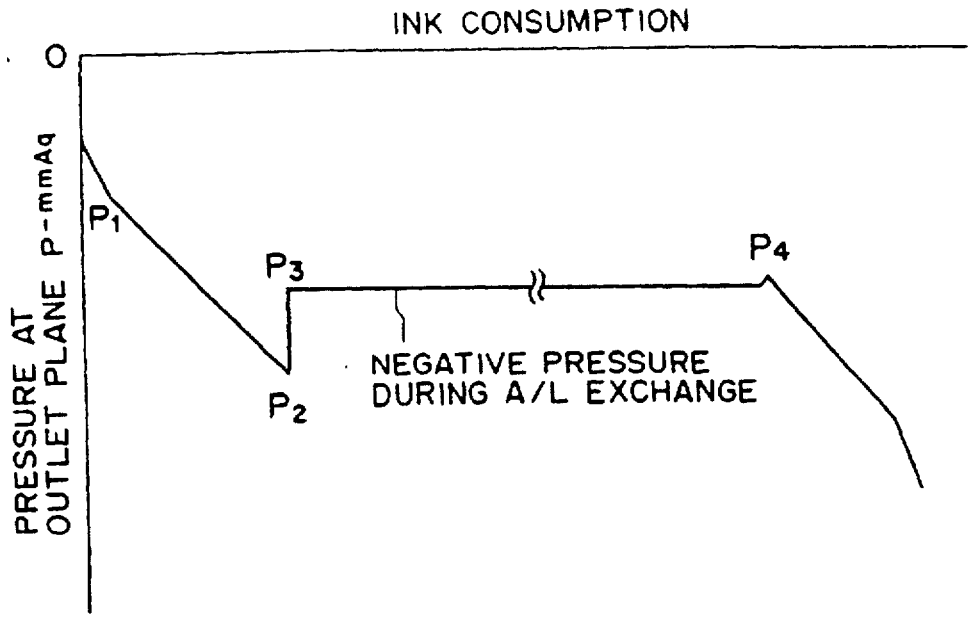

When the gas-liquid interface LL reaches the upper end of the first passage 50, the state in which the generated negative pressure is determined by the absorbing material 32 is changed to a state in which the generated negative pressure is determined by the negative pressure generated by the second passage 60, so that pressure rises from P2 (FIG. 5(B) to P3 (FIG. 5(C)). Thereafter, while the ink in the liquid containing chamber 36 is consumed while the gas-liquid exchange is carried out, the generated negative pressure is maintained constant (P3).

Immediately before the complete consumption of the ink in the liquid containing chamber 36, both of the air and the ink are present in the fluid communication path 40, and the ink remaining in the liquid containing chamber 36 is absorbed by the absorbing material 32, and therefore, the pressure temporarily rises to (P4).

With further continuation of the ink consumption, the ink in the absorbing material 32 is consumed until the supply limit is reached by the pressure lowering, and this is the use limit of the ink container 10.

Figure 7A:
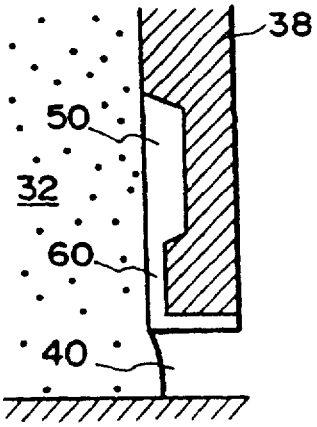

Referring to FIGS. 8(A), 8(B), 9(A) and 9(B), the description will be made as to another embodiment of the present invention, using FIGS. 7(A) and 7(B) which schematically show the foregoing embodiment. In FIGS. 7(A) to 9(B), the hatching in FIGS. 7(A), 8(A) and 9(A) indicates the section of a member, but in FIGS. 7(B) 8(B) and 9(A), it indicates the contact surface of the absorbing material 32.

Figure 7B:
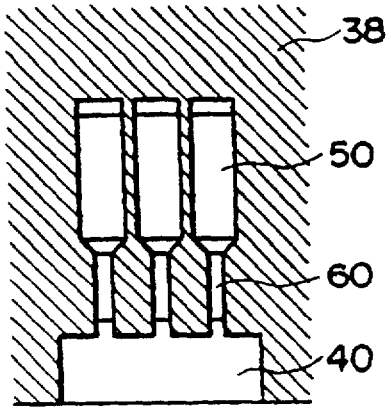

FIGS. 7(A) and 7(B) schematically show the foregoing embodiment, and three first passages 50 and three second passages 60 are formed in the partition 38, and are associated, respectively (1:1).

Figure 8A:
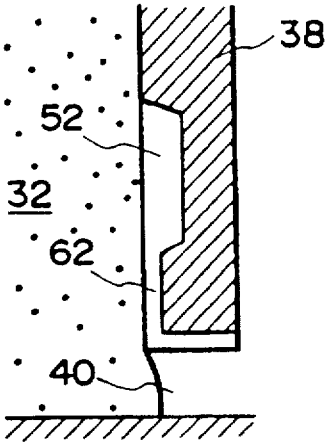
Figure 8B:
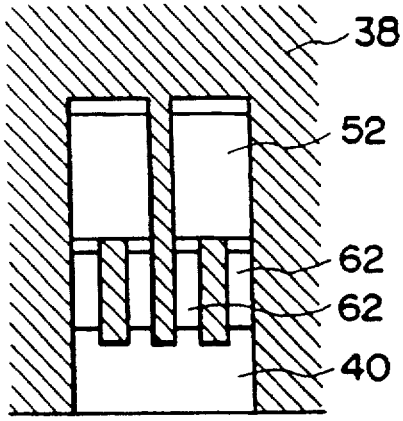
Figure 9A:
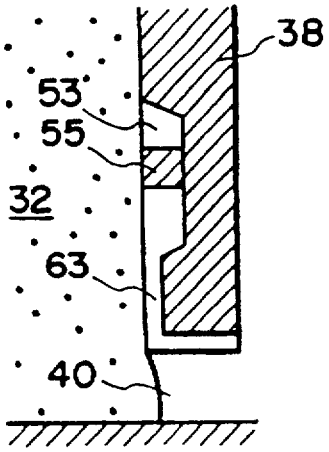
Figure 9B:
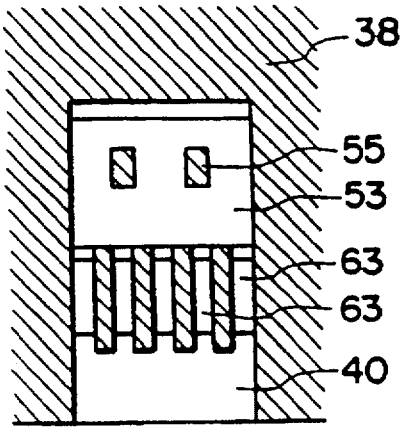

In FIGS. 8(A) and 8(B), the number of the first passages 52 as the ambience introduction path and the number of the second passages 62 as the capillary force generating portion are 1:2. More particularly, in this embodiment, two first passages 52 and four second passages 62 are formed in the partition 38.

Figure 9:
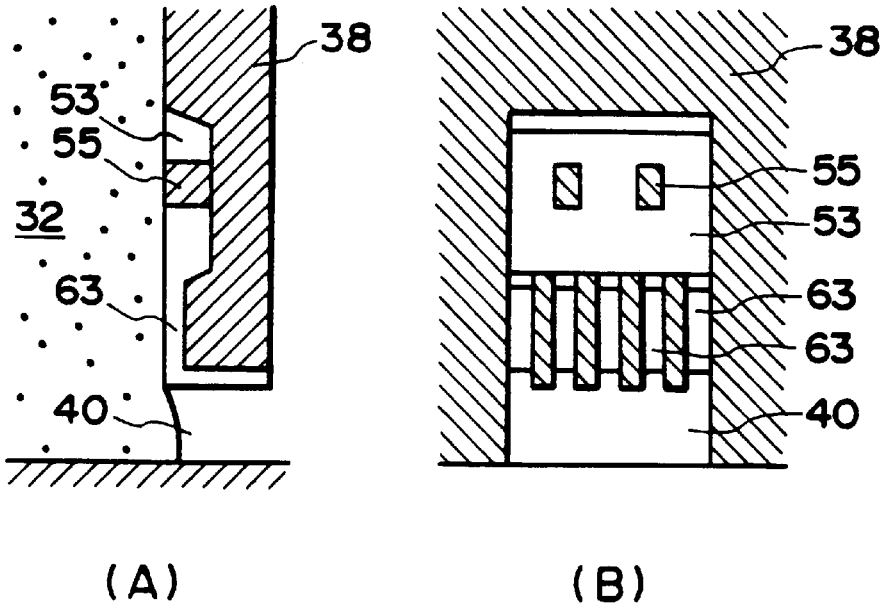
FIGS. 9(A)–9(B) are a schematic sectional view of FIG. 9(A) showing a container according to a further embodiment of the present invention, and a schematic front view of FIG. 9(B) of a partition.

In FIG. 9, the number of the first passages 53 as the ambience introduction path and the number of the second passages 63 as the capillary force generating portion are approx. 1:5. In this case, one of the first passages 53 has a large width into which the absorbing material 32 may enter too much extent with the result of blocking the passage, and therefore, it is preferable to form a rib 55 in the groove to bear the absorbing material 32. The number of the second passages 63 may be any if it is equal to or larger than 3.

The present invention is mainly directed to a large capacity ink container, but is not limited to it.

In the foregoing embodiments, the second passage is blocked by the liquid contained in the liquid accommodating container from the air when the gas-liquid exchange does not occur. However, the capillary force generating portion may be open to the ambience. This is because the capillary force generating portion can maintain the balance in this embodiment.

The distance between the fluid communication path and the supply port will be described. In order to properly supply the ink to the recording head, the balance of the negative pressures in the ink container is one of influential factors. During the period in which the ink supply operation is carried out with the gas-liquid exchange in the ink container including the liquid containing chamber and the negative pressure producing member accommodating chamber, when the negative pressure balance in the ink container satisfies the following:

$$|h|+|\delta h\times 1l_1|<|Hs|-|Hpa|$$

The supplying operation of the ink is proper with the gas-liquid interface height in the absorbing material (negative pressure producing member) maintained properly.

Figure 17:
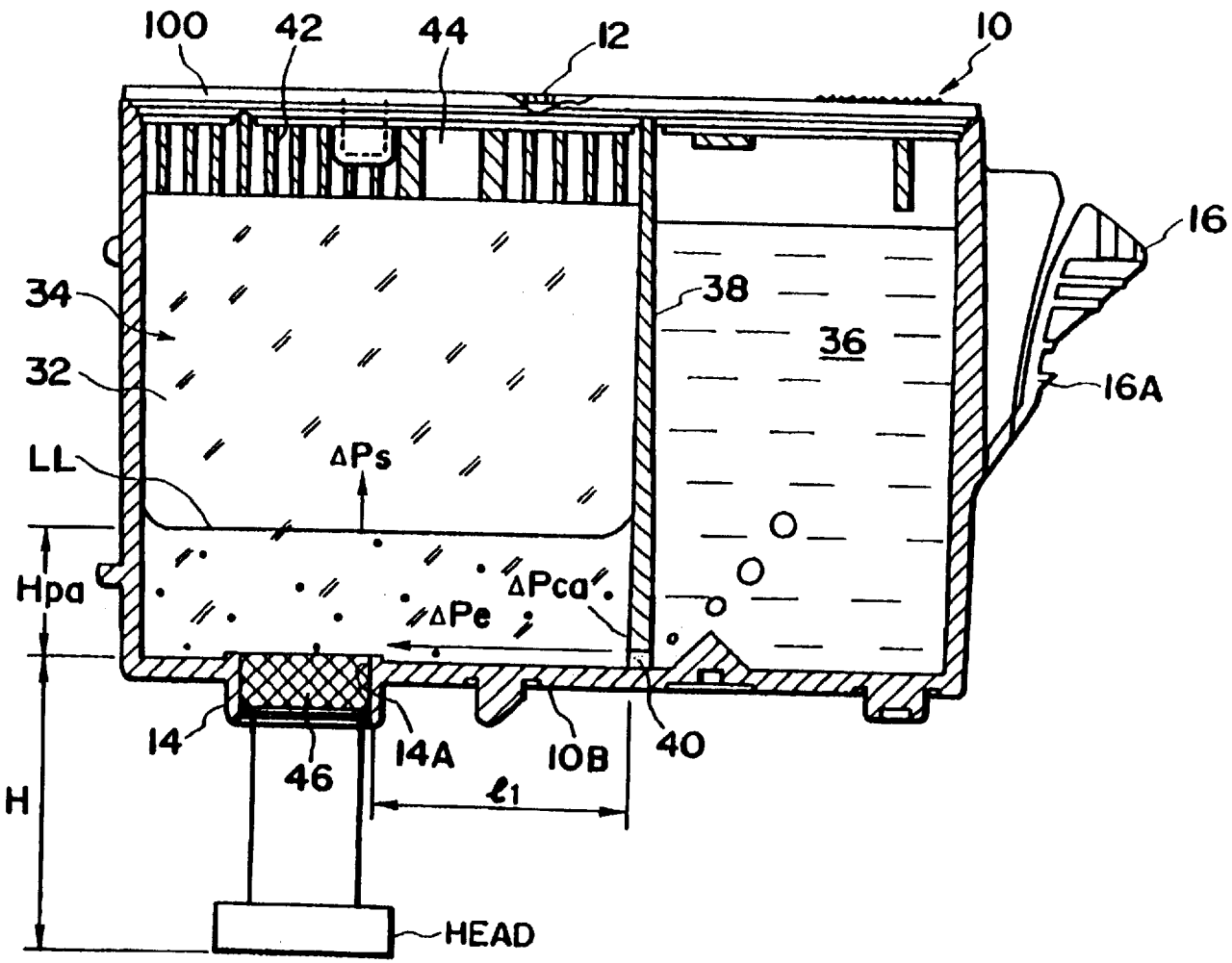
FIG. 17 is a schematic illustration of a parameter in an embodiment of present invention.

The liquid accommodating container has the structure shown in FIG. 17, and comprises a negative pressure producing member accommodating chamber accommodating a negative pressure producing member therein and including the air vent for fluid communication with the communication and a liquid supply opening for supplying the liquid to the recording means;

A liquid containing chamber which is substantially hermetically sealed except for a fluid communication path through which said liquid containing chamber is in fluid communication with said negative pressure producing member accommodating chamber;

A partition for separating said negative pressure producing member accommodating chamber and said liquid containing chamber;

A press-contact member in said liquid supply opening provided in a bottom surface of said negative pressure producing member accommodating chamber, wherein an upper end surface of the press-contact member is contacted to said negative pressure producing member;

Wherein a distanced between said fluid communication path and such a portion of said press-contact member as is closest to fluid communication path, satisfies:

$$l_1<(Hs-Hpa-h)/\delta h$$

h is a capillary force adjacent the fluid communication path defined by dividing the pressure by the density ϕ of the liquid to be ejected multiplied by the gravitational acceleration g (the dimension of h is length), that is, h=δPca/ϕg, where δPca is the pressure adjacent the fluid communication path; Hs is a capillary force defined by dividing the capillary force generated by the negative pressure producing member by the density ϕ of the liquid to be ejected multiplied by the gravitational acceleration g (the dimension of Hs is length), that is, Hs=δPs/ϕg, where δPs is the capillary force of the negative pressure producing member; Hp is a potential head difference between the gas-liquid interface in the negative pressure producing member and the neighborhood of the fluid communication path; δh is head loss defined by dividing a pressure loss between the fluid communication path and the liquid supply opening through the negative pressure producing member by the density ϕ multiplied by the gravitational acceleration g (the dimension of δh is length), that is, δh=δPe/ϕg, where δPe is the pressure loss). The pressure loss δPe is an integration, with the length of flux, of the pressure loss in each section which is determined on the basis of the cross-sectional area of the flux of the liquid to be ejected flowing through the negative pressure producing member, and therefore, it is proportional to the length of the flux and square of the flow speed, and is reversely proportional to the cross-sectional area of the flux.

The cross-sectional area is determined by a thickness of the negative pressure producing member multiplied by a height of the gas-liquid interface in the negative pressure producing member from the bottom of the negative pressure producing member accommodating chamber. Since however the negative pressure producing member is not uniform, it is difficult to determine the pressure loss, the cross-sectional area is deemed here as an average height of the gas-liquid interface in the negative pressure producing member multiplied by an average width of the negative pressure producing member. As regards the length of the flux, the maximum length is important, and therefore, it is deemed as the distance between the fluid communication path and the portion of the press-contact member which is most remote from the fluid communication path. When the pressure loss per unit length is δP, the pressure loss δPe is:

$$\delta Pe=\delta P\times l_1.$$

The average length of the flux is a distance from the fluid communication path to the central portion of the interface between the press-contact member and the negative pressure producing member.

Here, δPca>H, H is a static head from the neighborhood to the orifice. This is required to provide the recording head with a proper negative pressure. In FIG. 17, the ink container has a plain partition. In this example, the generated negative pressure δPca when the gas-liquid exchange occurs adjacent the fluid communication path is taken into account. The description will be made as to the case wherein a capillary force generating groove is positively formed in the partition.

Figure 18:
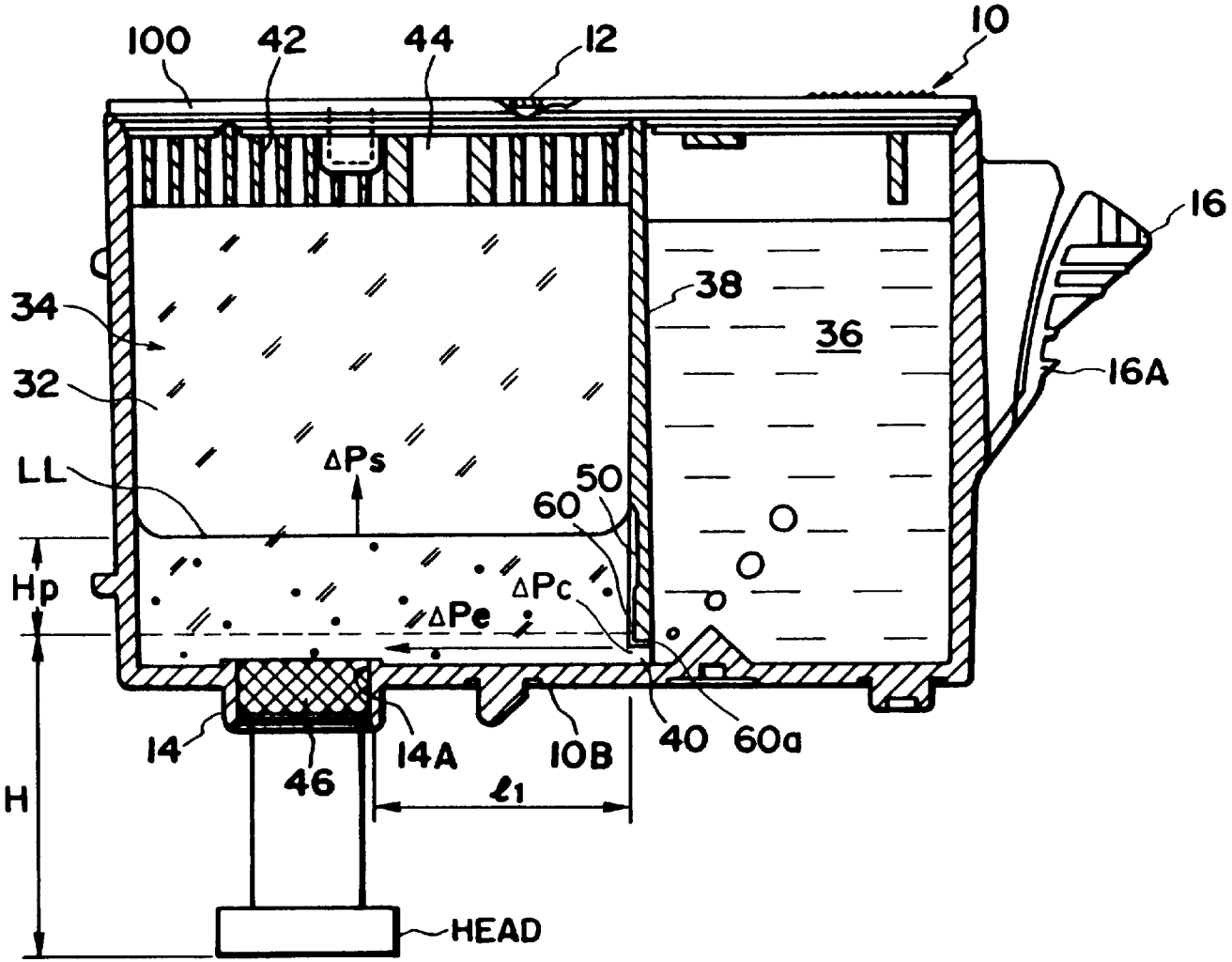
FIG. 18 is a schematic illustration of a parameter in an embodiment of the present invention.

The liquid accommodating container has a structure shown in FIG. 18, and the partition is provided with a capillary force generating groove 60 and an ambience introduction path 50 adjacent the fluid communication path.

The distance # $l_1$ from the fluid communication path to the portion which is most remote from the fluid communication path satisfies:

$$l_1<(Hs-Hp-h)/\delta h$$

h is a capillary force adjacent the fluid communication path defined by dividing the pressure by the density ϕ of the liquid to be ejected multiplied by the gravitational acceleration g (the dimension of h is length), that is, h=δPc/ϕg, where δPc is the pressure adjacent the fluid communication path; Hs is a capillary force defined by dividing the capillary force generated by the negative pressure producing member by the density ϕ of the liquid to be ejected multiplied by the gravitational acceleration g (the dimension of Hs is length), that is, Hs=δPs/ϕg, where δPs is the capillary force of the negative pressure producing member; Hp is a potential head difference between the gas-liquid interface in the negative pressure producing member and the neighborhood of the fluid communication path; δh is head loss defined by dividing a pressure loss between the fluid communication path and the liquid supply opening through the negative pressure producing member by the density ϕ multiplied by the gravitational acceleration g (the dimension of δh is length), that is, δh=δPe/ϕg, where δPe is the pressure loss). The pressure loss δPe is an integration, with the length of flux, of the pressure loss in each section which is determined on the basis of the cross-sectional area of the flux of the liquid to be ejected flowing through the negative pressure producing member, and therefore, it is proportional to the length of the flux and square of the flow speed, and is reversely proportional to the cross-sectional area of the flux. The cross-sectional area is determined by a thickness of the negative pressure producing member multiplied by a height of the gas-liquid interface in the negative pressure producing member from the bottom of the negative pressure producing member accommodating chamber. Since however the negative pressure producing member is not uniform, it is difficult to determine the pressure loss, the cross-sectional area is deemed here as an average height of the gas-liquid interface in the negative pressure producing member multiplied by an average width of the negative pressure producing member. As regards the length of the flux, the maximum length is important, and therefore, it is deemed as the distance between the fluid communication path and the portion of the press-contact member which is most remote from the fluid communication path. When the pressure loss per unit length is δP, the pressure loss δPe is:

$$\delta Pe=\delta P\times l_1.$$

The average length of the flux is a distance from the fluid communication path to the central portion of the interface between the press-contact member and the negative pressure producing member.

Here, δPca>H, H is a static head from the neighborhood to the orifice.

This is required to provide the recording head with a proper negative pressure.

Here, an ink container using a sponge which is 4 times heat-compressed.

The used ink has a Γ=30, "eta"=2, ϕ=1.06 g/cm$^3$. The ink flow amount is 1.44 g/min. The negative pressure in the orifice of the recording head immediately after the container is open is 25 mmAg. The initial ambience interface height after the opening is 40 mm. The negative pressure at the orifice when the gas-liquid exchange occurs 15 mmAg. The ambience interface height during the gas-liquid exchange hs=12 mm. In this case, δPs=90 mmAg, δPc=40 mmAg, δPe=0.5 mmAg/mm, $l_1$<(90-12-40)/0.5=76 mm.

When the $l_1$ was 75 mm in the experiments, stable operation was confirmed under normal operating condition.

However, since the ink reaches the user through various distribution channels, a safety factor should be added in consideration of external shock or the like. There is a liability that ink container drops due to operator's error. So, the upper limit, in consideration of a safety factor, of $l_1$ is preferably 60 mm approx. More safely, 50 mm approx. is preferable.

On the other hand, as regards the lower limit distance $l_1$, it is desirable to take the movement of the negative pressure producing member due to the pressing of the press-contact member into consideration.

For example, in the case of the container having a supply port provided with a press-contact member at the position approx. 5 mm away from the fluid communication path, the negative pressure producing member adjacent the fluid communication path moves to approx. 1 mm away from the fluid communication path by pressing the press-contact member by 3 mm. The negative pressure producing member accommodated in the container is pressed toward the communicating portion by 2.5 mm approx. in the communicating portion. Therefore, even if the negative pressure producing member moves as described above, the ink supply operation can be satisfactorily carried out.

However, a safety factor of 10 mm approx. is desirably taken into account in consideration of the variation factor upon insertion of the negative pressure producing member, the deviation due to external factors or the like.

From the foregoing, as a specific example of the position of the press-contact member, it is preferably not less than # $l_1$=5 mm and not more than 60 mm, and more safely, not less than # $l_1$=10 mm and not more than 50 mm.

Figure 19:
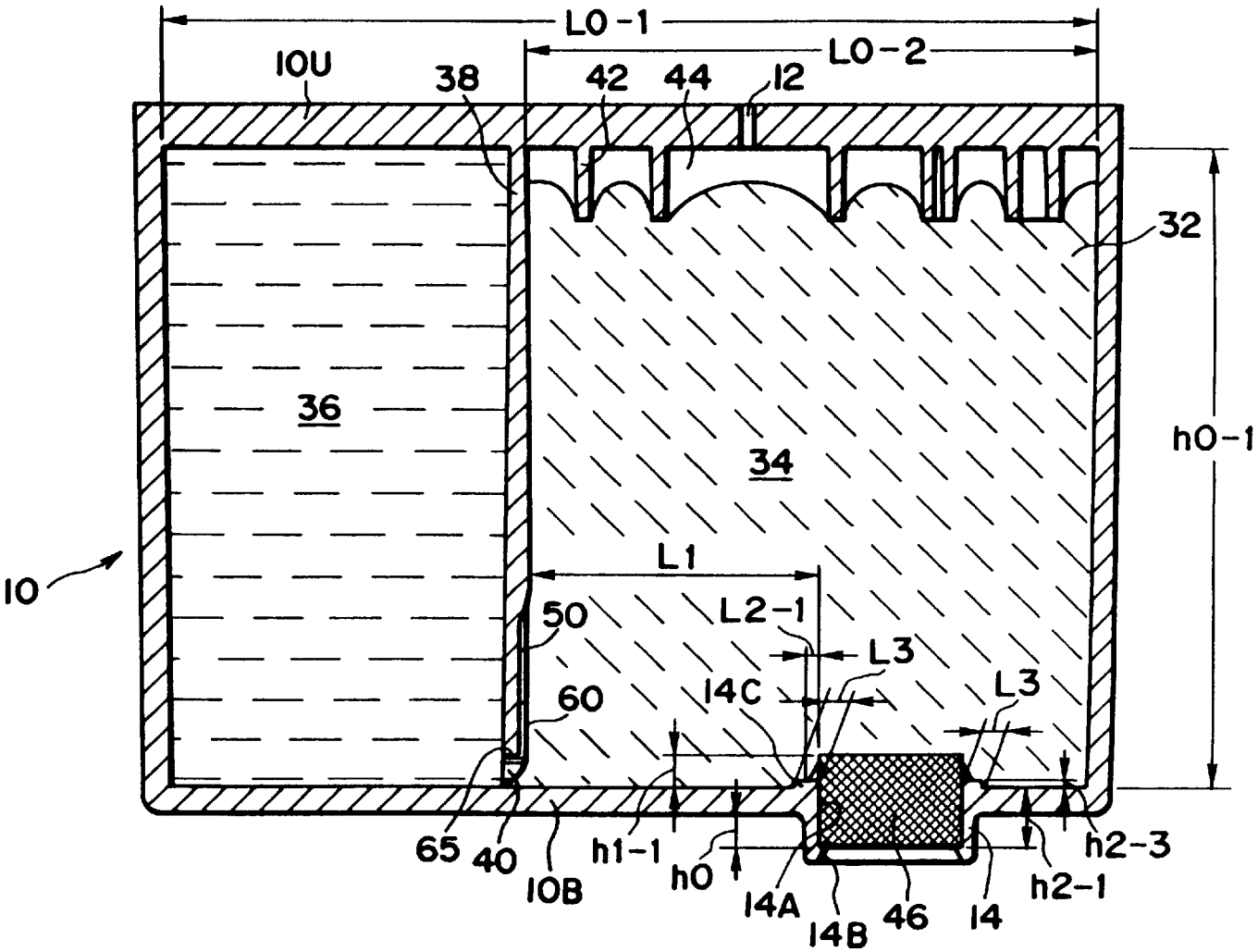
FIG. 19 is a sectional view of a major part of a liquid container for liquid ejection according to a further embodiment of the present invention.

Referring to FIG. 19, specific examples will be described.

The liquid container 10 for the liquid to be ejected comprises a negative pressure producing member accommodating chamber 34 which is in fluid communication with the air vent 12 at the upper portion and which in fluid communication with the liquid supply opening 14A at a lower portion and which accommodates the open cell elastic member 32 as the negative pressure producing member, a substantially hermetically sealed liquid containing chamber 36 for directly accommodating the liquid ink, and a partition 38 therebetween. The negative pressure producing member accommodating chamber 34 and the liquid containing chamber 36 is in fluid communication only through the fluid communication path 40 formed in the partition 38 at the bottom portion of the liquid container 10.

The upper wall 10U of the liquid container 10 defining the negative pressure producing member accommodating chamber 34 is provided with a plurality of inwardly projected ribs 42 intearal therewith, which are contacted to the open cell elastic member 32 accommodated under compression in the negative pressure producing member accommodating chamber 34. Therefore, an air buffer chamber 44 is formed between the wall 10U and the upper surface of the open cell elastic member 32. The open cell elastic member 32 is of heat-compressed urethane foam material, for example, and is accommodated in the negative pressure producing member accommodating chamber 34 under compression to generate predetermined capillary force as will be described hereinafter. The absolute value of the pore size of the open cell elastic member 32 for producing the predetermined capillary force is determined depending on the materials of the ink to be used, the dimensions of the liquid container 10, the position of the plane including the ejection outlets of the ink jet head 22 (static head difference H) or the like, but it is desirable to produce the capillary force larger than the capillary force in the capillary force generating groove or passage which will be described hereinafter.

In the ink supply cylinder 14 defining the liquid supply opening 14A, a disk-like or columnar press-contact member 46 is disposed. The press-contact member 46 per se is of polypropylene or felt for example, and it is not readily deformable by external force. When the container is not mounted in the container case 20 as shown in FIG. 3, the press-contact member 46 is maintained under the press-contact state wherein it is slightly pushed to the open cell elastic member 32 so as to locally compress the open cell elastic member 32. The degree of press-contact of the open cell elastic member 32 by the upper end surface of the press-contact member 46 is preferably not less than 0 mm from the inside surface of the bottom wall 10B of the container 10 and not more than 5 mm. To accomplish this, a flange 14B contacted to the neighborhood of the press-contact member 46, is formed at the end of the ink supply cylinder 14. The press-contact member 46 receives repelling force of approx. 300 gf from the open cell elastic member 32 so that it bends. To prevent disengagement thereof from the predetermined position in the ink supply cylinder 14, the aspect ratio of the thickness (height) in the section shown in FIG. 3 is preferably not less than 0.5.

In the embodiment of FIG. 19, the inner dimension L0-1 of the container 10 in the longitudinal direction is approx. 70 mm, the inner dimension h0-1 in the height direction is approx. 50 mm, inner dimension L0-2 of the first accommodation chamber 34 in the longitudinal direction is approx. 43–47 mm, and the distance L1 from the open cell elastic member 32 side surface of the partition 38 to the partition 38 side surface of the press-contact member 46 is approx. 22–26 mm. The fundamental thickness of the container 10 is generally approx. 2 mm. Around the liquid supply opening 14A of the container 10, there is provided an annular stepped portion 14C projected inwardly from the inner bottom surface of the bottom wall 10B of the container 10, and the height h2–3 thereof is 0.3–0.4 mm, and the width L3 is 1.5–3 mm.

The entering amount of the press-contact member 46 when the container 10 is mounted to the integral head type container case 20, that is, the difference between when the ink passage cylinder 26 of the color ink jet head 22 enters the ink supply cylinder 14 (FIG. 20) and when it is demounted and does not enter it (FIG. 19) (the difference between h1-1 in FIG. 19 and h1-2 in FIG. 20) is preferably approx. 1 mm. This is because then the proper flow of the ink is assured, and the leakage of the ink can be prevented when the liquid container 10 is dismounted.

More particularly, in the liquid container 10 of this embodiment, the ink enters and discharges from, the open cell elastic member 32 due to the temperature change or pressure change during use. In order to assuredly maintain the ink retention force (negative pressure) at the liquid supply opening, the meniscus force of the open cell elastic member 32 adjacent the liquid supply opening is to be maintained even when the ink passage cylinder 26 is dismounted from the ink supply cylinder 14. To accomplish this press-contact member 46 which is a hard absorbing member is provided.

Figure 21:
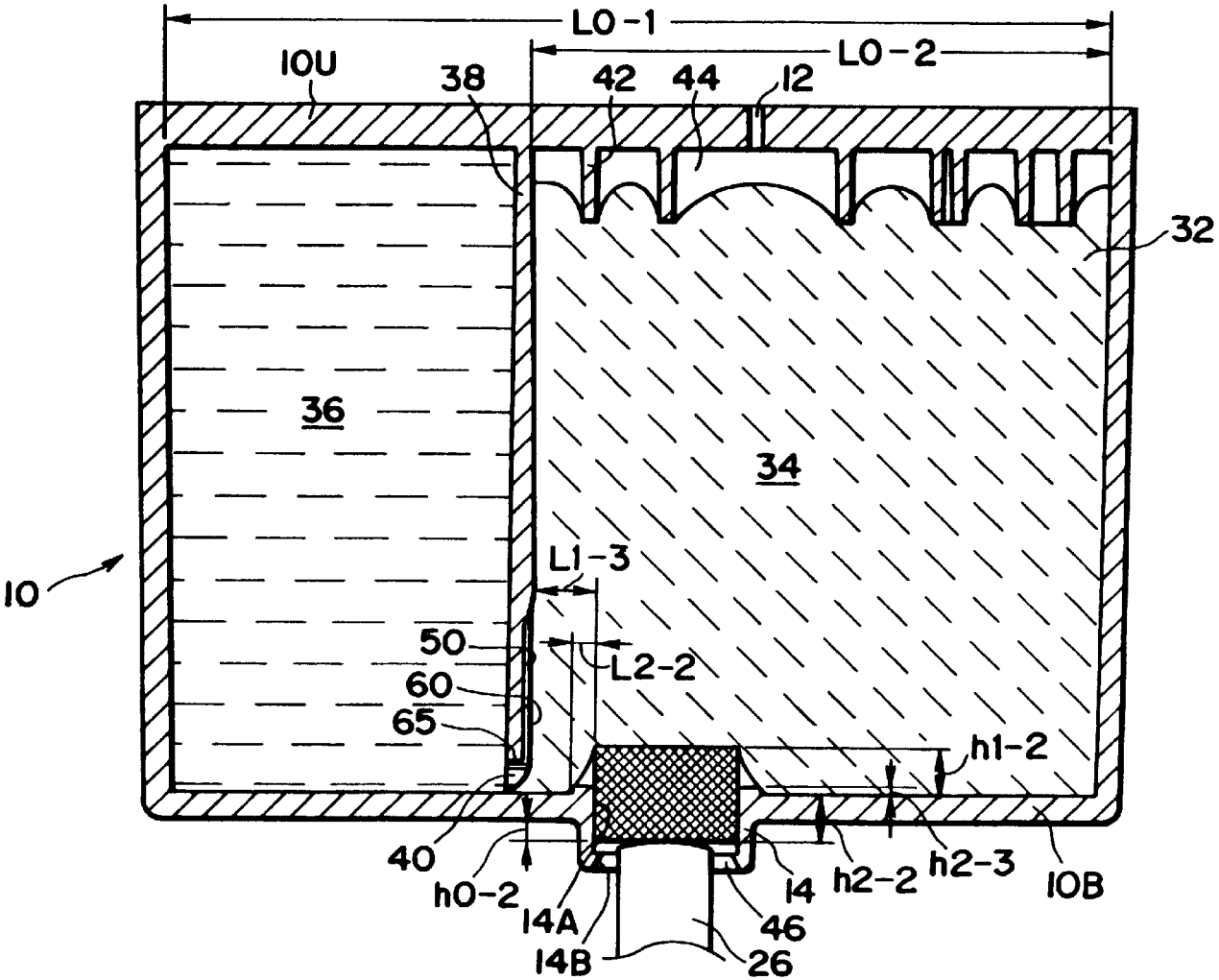
FIG. 21 is a sectional view of showing a liquid container for liquid to be ejected according to a further embodiment of the present invention.
Figure 22:
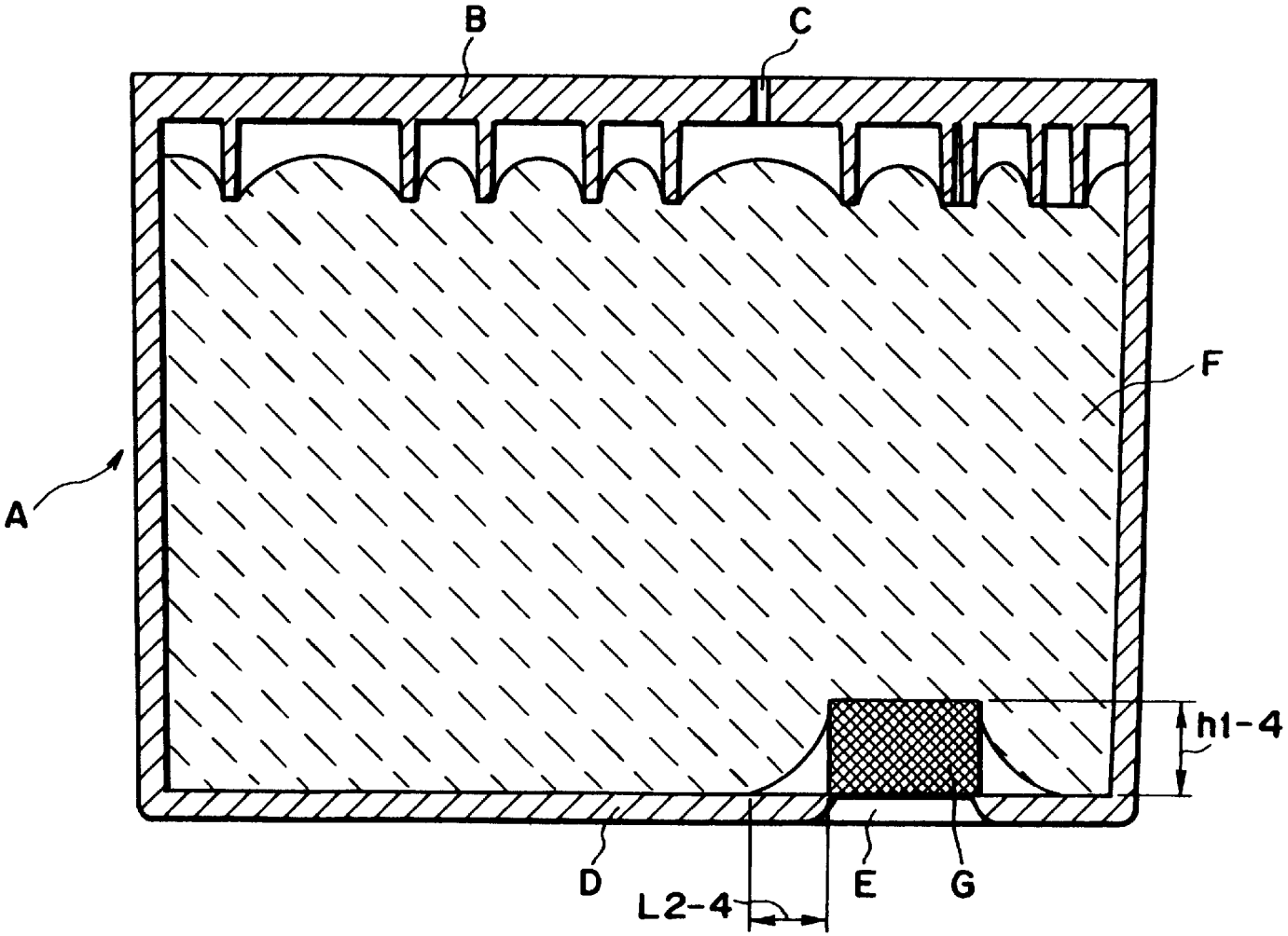
FIG. 22 is a sectional view of a conventional liquid container for liquid ejection.

In the embodiment shown in FIG. 21, the position of the liquid supply opening 14A is made different corresponding to the container case 20, and is adjacent the partition 38. The reason for this will be described. Since the press-contact member 46 is pushed to the open cell elastic member 32, the portion of the open cell elastic member 32 contacted to the press-contact member 46 locally deforms. Therefore, when the liquid supply opening 14A is too close to the fluid communication path 40 which is a gas-liquid exchange opening, the influence of the strain due to the deformation of the open cell elastic member 32 extends to the gas-liquid exchange opening, and therefore, the manufacturing variation of the liquid container 10 increases. In the worst case, the proper negative pressure cannot be generated with the possible result of ink dropping from the liquid supply opening 14A. Conversely, if the liquid supply opening 14A is too far from the fluid communication path 40 which is the gas-liquid exchange opening, the flow resistance from the fluid communication path 40 to the liquid supply opening 14A during the gas-liquid exchanging operation which will be described hereinafter is too large with the possible result of ink discontinuity (stop) when the ink consumption speed is high. Therefore, the distance from the fluid communication path 40 to the liquid supply opening 14A is preferably within a range. In the example shown in FIG. 19, the distance L1 is approx. 22–26 mm, and more generally, not more than approx. 30 mm, and in the example of FIG. 21, the distance L1-3 is approx. 5 mm.

The description will be made as to a structure for controlling the negative pressure generated by the open cell elastic member 32 as the negative pressure producing member.

In this embodiment, as shown in FIG. 19, the negative pressure producing member accommodating chamber 34 side of the lower portion of the partition 38 is provided with two parallel ambience introduction grooves 50 as first passages having top ends open to and contacted to the open cell elastic member 32 as the negative pressure producing member, and two parallel capillary force generating grooves 60 as the second passages in fluid communication with the ambience introduction grooves 50 and having bottom ends in fluid communication with the fluid communication path 40 (in the Figure only one of each of them is shown in section). The bottom end of the capillary force generating groove 60, as shown in Figure, may be continued to the groove 65 extended in the longitudinal direction at the upper side of the fluid communication path 40. By doing so, the passage can be assured even if the open cell elastic member 32 enters the groove at the lower end of the capillary force generating groove 60. It is preferable that ambience introduction groove 50 has a width which is larger than the capillary force generating groove 60, since then the ambience introduction is assured, and the resistance upon the gas-liquid exchange start is reduced. Each of the capillary force generating groove 60, as will be described hereinafter, can be deemed as a capillary tube for producing the capillary force, constituted by a groove surface in the partition 38 and one surface at the open cell elastic member 32 side.

The cross-sectional configuration of the capillary force generating groove may be selected from a variety of shapes, such as trapezoidal section, rectangular section, semicircular section or the like.

In the foregoing embodiment, the first and second passages are constituted by grooves, respectively, but they may be passages closed by themselves in the cross-section. More particularly, the lower portion of the partition 38 may be provided with an ambience introduction passage as the first passage having a top end opening to and contacted to the open cell elastic member 32 as the negative pressure producing member and a capillary force generating passage as the second passage in fluid communication with the ambience introduction passage and having a bottom end in fluid communication with the fluid communication path 40. By doing so, the capillary force generating passage is constituted without necessity of closing the open side of the groove by the open cell elastic member 32, so that capillary force generation can be determined without influence of the open cell elastic member 32.

The operation principle of the liquid container in this embodiment will be described.

Figure 20:
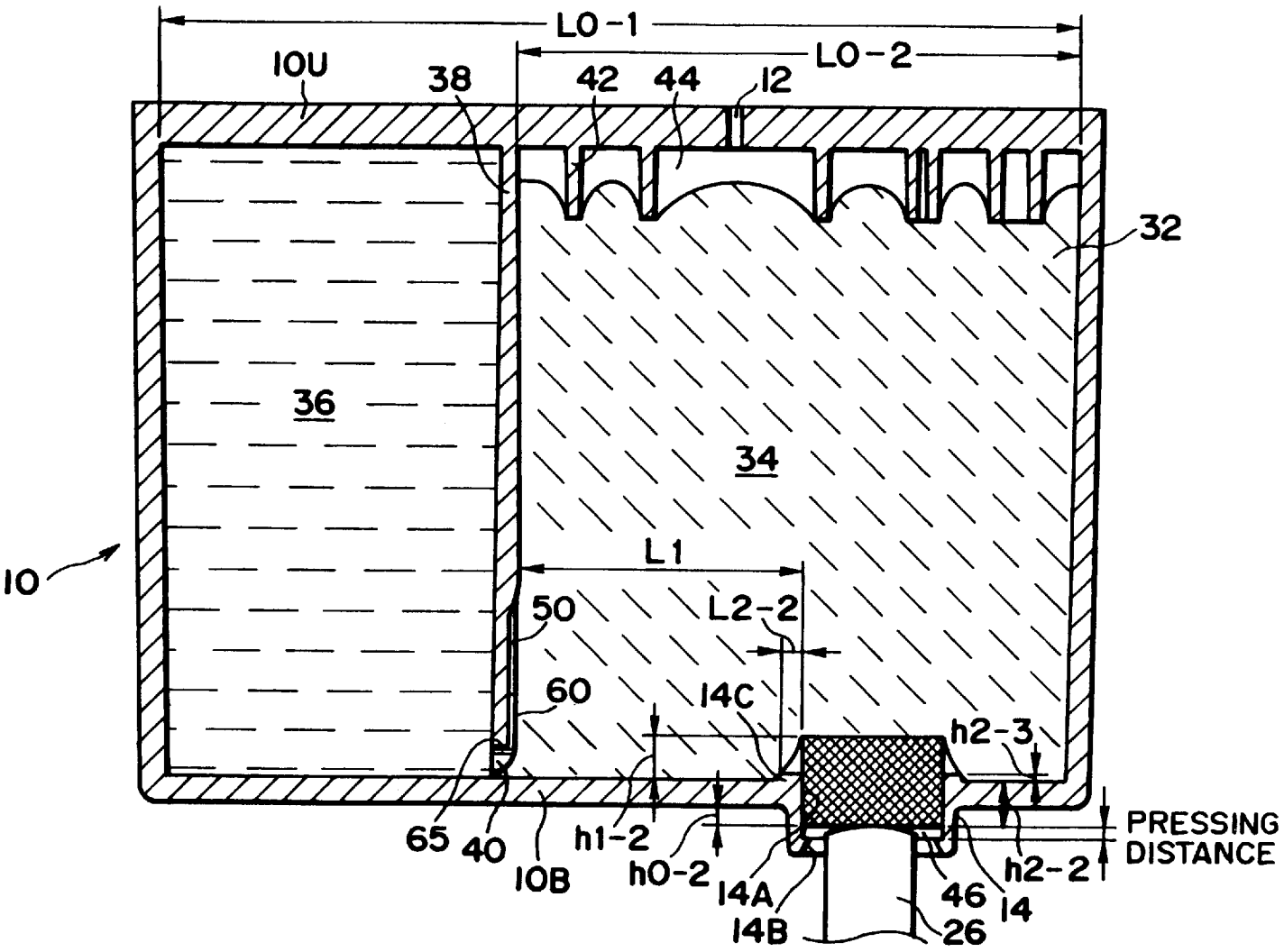
FIG. 20 is a sectional view of a major part of a liquid container for liquid ejection according to a further embodiment of the present invention.

As shown in FIG. 20, the ink passage cylinder 26 is pushed into the ink supply cylinder 14, and then the ink jet recording apparatus is operated. Then, the ink is ejected from the ink jet head 22 with the result of ink suction force produced in the liquid container 10.

When the open cell elastic member 32 which is a negative pressure producing member in the negative pressure producing member accommodating chamber 34 contains a sufficient amount of the ink, the ink is consumed from the negative pressure producing member so that upper surface (gas-liquid interface) of the upper surface lowers. The generated negative pressure at this time is determined by the static head and the capillary force at the gas-liquid interface in the negative pressure producing member.

With the continuing consumption of the ink, the gas-liquid interface reaches the top end portion of the ambience introduction groove 50. At the time when the pressures at the bottom portion of the liquid containing chamber 36 directly accommodating the ink and the negative pressure producing member 32 becomes lower than the capillary force generated in the capillary force generating groove 60, the air is supplied into the liquid containing chamber 36 through the ambience introduction groove 50 and the capillary force generating groove 60. As a result, the pressure in the liquid containing chamber 36 increases corresponding to the amount of introduced air, and the ink is supplied from the liquid containing chamber 36 into the negative pressure producing member 32 through the fluid communication path 40 so as to compensate for the difference between the increased pressure and the pressure of the negative pressure producing member 32. Namely, the gas-liquid exchange is carried out.

At this time, the pressure at the bottom portion of the container rises corresponding to the ink supply amount, and therefore, the supply of the air into the liquid containing chamber 36 stops.

During the ink consumption, the gas-liquid exchange occurs continuously, so that ink in the liquid containing chamber 36 is supplied into the negative pressure producing member 32. Therefore, the generated negative pressure during the consumption of the ink from the liquid containing chamber 36 is determined by the capillary force generated by the capillary force generating groove 60. So, by properly selecting the dimensions of the capillary force generating groove 60, the generated negative pressure during the gas-liquid exchange can be determined.

When the ink is supplied through the fluid communication path 40 from the liquid containing chamber 36 into the open cell elastic member 32, that is, when the gas-liquid exchange is carried out, the ink flows at the lower portion of the open cell elastic member 32, that is, in the range of 10–20 mm from the inside of the bottom wall 10B of the container 10. Therefore, if there is large gap, or if the compression ratio of the open cell elastic member is too high, as in a conventional container, the flow of the ink may be impeded. However, according to this embodiment, the lower end surface of the press-contact member 46 is outer by the distance corresponding to h2-1 than the inside of the bottom wall 10B, and therefore, the press-contact member 46 does not enter by the distance corresponding to h2-2, and the inward projection distance from the inside bottom is h1-2, even if the ink passage cylinder 26 is pushed into the ink supply cylinder 14 by a predetermined amount (1 mm) (mounting state) as shown in FIG. 20. Therefore, the gap due to the separation distance L2-2 from the inside bottom of the container of the open cell elastic member 32 is small. The separation distance L2-2 is 2–3 mm at most. As a result, when the gas-liquid exchange occurs, the ink flows in the range of 10–20 mm from the inside surface of the bottom wall 10B of the container 10 in the open cell elastic member 32, and therefore, the flow of the ink is hardly impeded in the liquid container of this embodiment, wherein the gap adjacent the press-contact member 46 is small.

In addition, the increase of the compression ratio of the open cell elastic member 32 adjacent the contact portion with the press-contact member 46 (top surface) is properly controlled, and therefore, the ink flow is not impeded by the flow resistance increase due to the increase of compression ratio the open cell elastic member 32.

Furthermore, around the liquid supply opening 14A, there is provided a stepped portion 14C inwardly projected from the inside surface of the bottom wall 10B of the container 10, and therefore, the open cell elastic member 32 is compressed inwardly by two steps. The step height is relatively small (0.3–0.7 mm), so that shape of the open cell elastic member 32 follows the step, and no gap is formed. The entering degree of the press-contact member 46 entering degree which causes the separation of the open cell elastic member 32 from the inside of the bottom wall 10B is (h1-2) (stepped portion 14C height), so that expansion of the gap corresponding to the stepped portion 14C is suppressed.

What is claimed is:

1. A container for containing liquid to be ejected, comprising:

a negative pressure producing member accommodating chamber for accommodating a negative pressure producing member, said negative pressure producing member accommodating chamber being provided with an air vent for fluid communication with ambience and a liquid supply portion for supplying the liquid to a liquid ejecting head having ejection outlets;

a liquid containing chamber substantially hermetically sealed except for a fluid communication path through which said liquid containing chamber is in fluid communication with said negative pressure producing member accommodating chamber;

a partition for separating said negative pressure producing member accommodating chamber and said liquid containing chamber, said partition being provided with an ambience introduction path for introducing the ambience into said liquid containing chamber from said negative pressure producing member accommodating chamber, said ambience introduction path forming a capillary force generating portion;

wherein the capillary force produced by said capillary force generating portion satisfies the following:

$$H<h\leqq Hs-Hp-\delta h$$

where h is a capillary force defined by dividing the capillary force generating portion by the density $\phi$ of the liquid to be ejected multiplied by the gravitational acceleration g (the dimension of H is length), that is, $h=\delta Pc/\phi g$, where $\delta Pc$ is the generated capillary force; H is a potential head difference between the capillary force generating portion and the liquid ejecting head plane including the ejection outlets; Hs is a capillary force defined by dividing the capillary force generated by the negative pressure producing member by the density $\phi$ of the liquid to be ejected multiplied by the gravitational acceleration g (the dimension of H is length), that is, $Hs=\delta Ps/\phi g$, where $\delta Ps$ is the capillary force of the negative pressure producing member; Hp is a potential head difference between a gas-liquid interface in the negative pressure producing member and the capillary force generating portion; $\delta h$ is head loss defined by dividing a pressure loss between the fluid communication path and the liquid supply opening through the negative pressure producing member by the density $\phi$ multiplied by the gravitational acceleration g (the dimension of $\delta h$ is length), that is, $\delta h=\delta Pe/\phi g$, where $\delta Pe$ is the pressure loss.

2. A container according to claim 1, wherein said capillary force generating portion has a circumferential length L and a cross-sectional area S, and the h is expressed by $$h=L/S\times\Gamma/\phi g\times\cos\theta$$

where $\phi$ is the density of the liquid, g is the gravitational acceleration, $\Gamma$ is the surface tension of the liquid, and $\theta$ is a contact angle of the liquid.

3. A container according to claim 1, wherein the capillary force of said capillary force generation portion is between minimum and maximum of capillary forces of liquids of different kinds and colors usable with the liquid ejecting head.

4. A container according to claim 1, wherein said liquid supply opening is provided at a bottom portion of the container.

5. A container according to claim 1, wherein said container is integral with the liquid ejecting head.

6. A container according to claim 1, wherein said container is detachably mountable relative to said liquid ejecting head.

7. A container according to claim 1, wherein an upper end of the ambience introduction path maintains fluid communication with the ambience after start of gas-liquid exchange.

8. A container according to claim 1, wherein said negative pressure producing member has a height in said negative pressure producing member accommodating chamber, which is not less than 40 mm.

9. A container according to claim 1, wherein an air buffer chamber is formed above said negative pressure producing member in said negative pressure producing member accommodating chamber, said air buffer chamber being in fluid communication with said air vent, and wherein a volume ratio of the air buffer chamber and said negative pressure producing member accommodating chamber is ⅕–⅛.

10. A container according to claim 1, wherein the volume ratio of said negative pressure producing member accommodating chamber and said liquid containing chamber is 1:1 to 5:3.

11. A container according to claim 1, wherein said negative pressure producing member is liquid absorbing foamed polyurethane resin material.

12. A container according to claim 1, wherein said fluid communication path has a width which is smaller than a width of a bottom portion of said partition.

13. A container according to claim 1, wherein a top level of said ambience introduction path is higher than the upper end of said ambience introduction path by 10–30 mm.

14. A container according to claim 1, wherein a distance between said fluid communication path and said ejection liquid supply port is 10–50 mm.

15. A container according to claim 1, wherein said container contains the liquid to be supplied to said liquid ejecting head.

16. A container according to claim 1, wherein at least an upper end of said ambience introduction path is open to and contacted to said negative pressure producing member, and a lower end thereof is in fluid communication with said fluid communication path.

17. A container according to claim 16, wherein said ambience introduction path has plural secondary passages constituting the capillary force generating portion and another passage having a cross-sectional area which is larger than that of said plural passages.

18. A container according to claim 16, wherein said ambience introduction path has a second passage constituting the capillary force generating portion and a first passage having a cross-sectional area which is larger than that of said second passage.

19. A container according to claim 18, wherein said first passage and said second passage are an ambience introduction groove and a capillary force generating groove, respectively, open parts of which are closed by said negative pressure producing member.

20. A container according to claim 18, wherein said ambience introduction path is a groove, an open part of which is closed by said negative pressure producing member.

21. A container according to claim 20, wherein said groove is in fluid communication with a longitudinal groove extended in a longitudinal direction of said fluid communication path.

22. A container according to claim 20, wherein said capillary force generating groove has a rectangular section having a width×a depth of 0.20–0.40 mm×0.20–0.40 mm.

23. A container according to claim 20, wherein said capillary force generating groove has a length of 2–10 mm.

24. A container according to claim 20, wherein said capillary force generating groove has a trapezoidal section.

25. A container according to claim 20, wherein said capillary force generating groove has a triangular shape section.

26. A container according to claim 20, wherein said capillary force generating groove has a semicircular section at least in a part thereof.

27. A container according to claim 1, wherein said liquid supply portion is provided with a press-contact member contacted to said negative pressure producing member.

28. A container according to claim 27, wherein said press-contact member is of felt of polypropylene.

29. A container according to claim 27, wherein said press-contact member is pressed into said negative pressure producing member, and an entering distance thereof is 0.5–2 mm when said liquid container is not connected with said liquid ejecting head, and is 1.0–3.0 mm when it is connected therewith.

30. A container for containing liquid to be ejected, comprising:

a negative pressure producing member accommodating chamber for accommodating a negative pressure producing member, said negative pressure producing member accommodating chamber being provided with an air vent for fluid communication with ambience and a liquid supply portion for supplying the liquid to a liquid ejecting head having ejection outlets;

a liquid containing chamber substantially hermetically sealed except for a fluid communication path through which said liquid containing chamber is in fluid communication with said negative pressure producing member accommodating chamber;

a partition for separating said negative pressure producing member accommodating chamber and said liquid containing chamber;

said partition being provided with an ambience introduction path for introducing the ambience into said liquid containing chamber from said negative pressure producing member accommodating chamber, said ambience introduction path forming a capillary force generating portion;

wherein the capillary force produced by said capillary force generating portion satisfies the following:

$$H+hm<h\leqq Hs-Hp-\delta h$$

where h is a capillary force defined by dividing the capillary force generated by the capillary force generating portion by the density $\phi$ of the liquid to be ejected multiplied by the gravitational acceleration g (the dimension of h is length), that is, $h=\delta Pc/\phi g$, where $\delta Pc$ is the generated capillary force; H is a potential head difference between the capillary force generating portion and the liquid ejecting head plane including the ejection outlets; Hs is a capillary force defined by dividing the capillary force generated by the negative pressure producing member by the density $\phi$ of the liquid to be ejected multiplied by the gravitational acceleration g (the dimension of H is length), that is, $Hs=\delta Ps/\phi g$, where $\delta Ps$ is the capillary force of the negative pressure producing member; Hp is a potential head difference between a gas-liquid interface in the negative pressure producing member and the capillary force generating portion; $\delta h$ is head loss defined by dividing a pressure loss between the fluid communication path and the liquid supply opening through the negative pressure producing member by the density $\phi$ multiplied by the gravitational acceleration g (the dimension of $\delta h$ is length), that is, $\delta h=\delta Pe/\phi g$, where $\delta Pe$ is the pressure loss), wherein hm is a design margin capillary force divided by the density $\phi$ multiplied by the gravitational acceleration g (dimension is length), that is, $hm=\delta Pm/\phi g$, where $\delta Pm$ is a design margin capillary force.

31. A container according to claim 30, wherein said capillary force generating portion has a circumferential length L and a cross-sectional area S, the liquid to be elected has a surface tension $\Gamma$ and a density $\phi$, and the h is expressed by $$h=L/S\times\Gamma/\phi g\times\cos\theta$$

where L is the circumferential length in cm of the capillary force generating portion; S is the cross-sectional area in $cm^2$; $\Gamma$ is the surface tension in dyn/cm; $\theta$ is a contact angle; $\phi$ is the density in $g/cm^3$; and g is the gravitational acceleration being 980 $cm/s^2$.

32. A container according to claim 30, wherein a capillary force of said capillary force generating portion is between minimum and maximum of capillary forces of the liquids of different kinds and colors usable with the ejection head.

33. A container according to claim 30, wherein said liquid supply portion is provided at a bottom portion of the container.

34. A container according to claim 30, wherein said container is integral with the liquid ejecting head.

35. A container according to claim 30, wherein said container is detachably mountable relative to said liquid ejecting head.

36. A container according to claim 30, wherein an upper end of the ambience introduction path maintains fluid communication with the ambience after start of gas-liquid exchange.

37. A container according to claim 30, wherein said negative pressure producing member has a height in said negative pressure producing member accommodating chamber, which is not less than 40 mm.

38. A container according to claim 30, wherein an air buffer chamber is formed above said negative pressure producing member in said negative pressure producing member accommodating chamber, said air buffer chamber being in fluid communication with said air vent, and wherein a volume ratio of the air buffer chamber and said negative pressure producing member accommodating chamber is $1/5$–$1/8$.

39. A container according to claim 30, wherein the volume ratio of said negative pressure producing member accommodating chamber and said liquid containing chamber is 1:1 to 5:3.

40. A container according to claim 30, wherein said negative pressure producing member is liquid absorbing foamed polyurethane resin material.

41. A container according to claim 30, wherein said fluid communication path has a width which is smaller than a width of a bottom portion of said partition.

42. A container according to claim 30, wherein a top level of said ambience introduction path is higher than the upper end of said ambience introduction path by 10–30 mm.

43. A container according to claim 30, wherein a distance between said fluid communication path and said ejection liquid supply port is 10–50 mm.

44. A container according to claim 30, wherein said container contains the liquid to be supplied to said liquid ejecting head.

45. A container according to claim 30, wherein at least an upper end of said ambience introduction path is open to and contacted to said negative pressure producing member, and a lower end thereof is in fluid communication with said fluid communication path.

46. A container according to claim 45, wherein said ambience introduction path has plural passages constituting the capillary force generating portion and another passage having a cross-sectional area which is larger than that of said plural passages.

47. A container according to claim 45, wherein said ambience introduction path has a second passage constituting the capillary force generating portion and a first passage having a cross-sectional area which is larger than that of said second passage.

48. A container according to claim 47, wherein said first passage and said second passage are an ambience introduction groove and a capillary force generating groove, respectively, open parts of which are closed by said negative pressure producing member.

49. A container according to claim 47, wherein said ambience introduction path is a groove, an open part of which is closed by said negative pressure producing member.

50. A container according to claim 49, wherein said groove is in fluid communication with a longitudinal groove extended in a longitudinal direction of said fluid communication path.

51. A container according to claim 49, wherein said capillary force generating groove has a rectangular section having a width×a depth of 0.20–0.40 mm×0.20–0.40 mm.

52. A container according to claim 49, wherein said capillary force generating groove has a length of 2–10 mm.

53. A container according to claim 49, wherein said capillary force generating groove has a trapezoidal section.

54. A container according to claim 49, wherein said capillary force generating groove has a triangular shape section.

55. A container according to claim 49, wherein said capillary force generating groove has a semicircular section at least in a part thereof.

56. A container according to claim 30, wherein said liquid supply opening is provided with a press-contact member contacted to said negative pressure producing member.

57. A container according to claim 56, wherein said press-contact member is of felt of polypropylene.

58. A container according to claim 56, wherein said press-contact member is pressed into said negative pressure producing member, and an entering distance thereof is 0.5–2 mm when said liquid container is not connected with said liquid ejecting head, and is 1.0–3.0 mm when it is connected therewith.

59. A container for containing liquid to be ejected, comprising:

a negative pressure producing member accommodating chamber for accommodating a negative pressure producing member, said negative pressure producing member accommodating chamber being provided with an air vent for fluid communication with ambience and a liquid supply portion for supplying liquid to a liquid ejecting head having ejection outlets;

a liquid containing chamber substantially hermetically sealed except for a fluid communication path through which said liquid containing chamber is in fluid communication with said negative pressure producing member accommodating chamber;

a partition for separating said negative pressure producing member accommodating chamber and said liquid containing chamber, wherein said partition is provided with a capillary force generating portion therein;

a press-contact member in said liquid supply opening provided at a bottom side of said negative pressure producing member accommodating chamber, the press-contact member being substantially non-deformable, and an upper end surface of the press-contact member being contacted to said negative pressure producing member;

wherein a distance $l_1$ from said fluid communication path to a portion of said press-contact member which is closest to said fluid communication path satisfies the following:

$$l_1<(Hs-Hpa-h)/\delta h$$

where h is a capillary force adjacent the fluid communication path defined by dividing the pressure by the density $\phi$ of the liquid to be ejected multiplied by the gravitational acceleration g (the dimension of h is length), that is, $h=\delta Pca/\phi g$, where $\delta Pca$ is the pressure adjacent the fluid communication path; Hs is a capillary force defined by dividing the capillary force generated by the negative pressure producing member by the density $\phi$ of the liquid to be ejected multiplied by the gravitational acceleration g (the dimension of Hs is length), that is, $Hs=\delta Ps/\phi g$, where $\delta Ps$ is the capillary force of the negative pressure producing member; Hp is a potential head difference between a gas-liquid interface in the negative pressure producing member and the neighborhood of the fluid communication path; $\delta h$ is head loss defined by dividing a pressure loss between the fluid communication path and the liquid supply opening through the negative pressure producing member by the density $\phi$ multiplied by the gravitational acceleration g (the dimension of $\delta h$ is length), that is, $\delta h=\delta Pe/\phi g$, where $\delta Pe$ is the pressure loss.

60. A container according to claim 59, wherein a lower end surface of said press-contact member is out of an inner bottom surface of said container.

61. A container according to claim 59, wherein around said liquid supply portion, a stepped portion inwardly projecting from an inner bottom surface of said container is provided.

62. A container according to claim 59, wherein said liquid supply opening is formed in a liquid supply cylinder formed outwardly from an outer surface of a bottom wall of said container.

63. A container according to claim 59, wherein said container contains the liquid to be supplied to the liquid electing head.

64. A container for containing liquid to be ejected, comprising:

a negative pressure producing member accommodating chamber for accommodating a negative pressure producing member, said negative pressure producing member accommodating chamber being provided with an air vent for fluid communication with ambience and a liquid supply portion for supplying the liquid to a liquid ejecting head having ejection outlets;

a liquid containing chamber substantially hermetically sealed except for a fluid communication path through which said liquid containing chamber is in fluid communication with said negative pressure producing member accommodating chamber;

a partition for separating said negative pressure producing member accommodating chamber and said liquid containing chamber, said partition being provided with an ambience introduction path for providing a capillary force generating portion in said partition wall and for introducing ambience into said liquid containing chamber from said negative pressure producing member accommodating chamber;

a press-contact member in said liquid supply opening provided at a bottom side of said negative pressure producing member accommodating chamber, the press-contact member being substantially non-deformable, and an upper end surface of the press-contact member being contacted to said negative pressure producing member;

wherein a distance $l_1$ from said fluid communication path to a portion of said press-contact member which is closest to said fluid communication path satisfies the following:

$$l_1<(Hs-Hp-h)/\delta h$$

where h is a capillary force adjacent the fluid communication path defined by dividing the pressure by the density $\phi$ of the liquid to be ejected multiplied by the gravitational acceleration g (the dimension of h is length), that is, $h=\delta Pc/\phi g$, where $\delta Pc$ is the pressure adjacent the fluid communication path; Hs is a capillary force defined by dividing the capillary force generated by the negative pressure producing member by the density $\phi$ of the liquid to be ejected multiplied by the gravitational acceleration g (the dimension of Hs is length), that is, $Hs=\delta Ps/\phi g$, where $\delta Ps$ is the capillary force of the negative pressure producing member; Hp is a potential head difference between a gas-liquid interface in the negative pressure producing member and the neighborhood of the fluid communication path; $\delta h$ is head loss defined by dividing a pressure loss between the fluid communication path and the liquid supply opening through the negative pressure producing member by the density $\phi$ multiplied by the gravitational acceleration g (the dimension of $\delta h$ is length), that is, $\delta h=\delta Pe/\phi g$, where $\delta Pe$ is the pressure loss.

65. A container according to claim 64, wherein around said liquid supply portion, a stepped portion inwardly projecting from an inner bottom surface of said container is provided.

66. A container according to claim 64, wherein said liquid supply portion is formed in a liquid supply cylinder formed outwardly from an outer surface of a bottom wall of said container.

67. A container according to claim 64, wherein said container contains the liquid to be supplied to the liquid electing head.

68. A container according to claim 64, wherein a lower end surface of said press-contact member is out of an inner bottom surface of said container.

69. A container according to claim 68, wherein the distance $l_1$ further satisfies the following:

$10\ mm \leqq l_1 \leqq 50\ mm$.

70. A container for containing liquid to be ejected, comprising:

a negative pressure producing member accommodating chamber for accommodating a negative pressure producing member, said negative pressure producing member accommodating chamber being provided with an air vent for fluid communication with ambience and a liquid supply portion for supplying the liquid to a liquid ejecting head having ejection outlets;

a liquid containing chamber substantially hermetically sealed except for a fluid communication path through which said liquid containing chamber is in fluid communication with said negative pressure producing member accommodating chamber;

a partition extending up from said fluid communication path of said negative pressure producing member accommodating chamber;

a press-contact member in said liquid supply opening provided at a bottom side of said negative pressure producing member accommodating chamber, the press-contact member being substantially non-deformable, and an upper end surface of the press-contact member being contacted to said negative pressure producing member, wherein a lower end surface of said press-contact member is out of an inner bottom surface of said container;

wherein a distance $l_1$ from a fluid communication path to a portion of said press-contact member closest to said fluid communication path, satisfies the following:

$5\ mm \leqq l_1 \leqq 60\ mm$.

* * * * *

UNITED STATES PATENT AND TRADEMARK OFFICE

CERTIFICATE OF CORRECTION

PATENT NO. : 6,145,972
DATED : November 14, 2000
INVENTOR(S) : Udagawa et al.

Figure 13A:
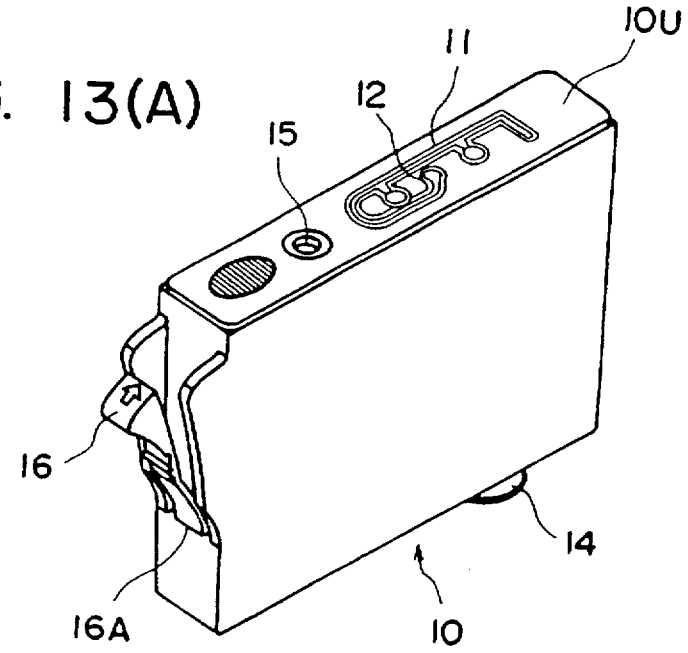

It is certified that error appears in the above-identified patent and that said Letters Patent is hereby corrected as shown below:

Drawings,
Sheet 1, replace FIG. 1 with attached FIGs. 1(A) and 1(B);
Sheet 5, replace FIG. 5 with attached FIGs. 5(A) to 5(C);
Sheet 6, replace FIG. 7 with attached FIGs. 7(A) and 7(B);
Sheet 7, replace FIG. 8 with attached FIGs. 8(A) and 8(B); replace FIG. 9 with attached FIGs. 9(A) and 9(B);
Sheet 8, replace FIG. 10 with attached FIGs. 10(A), 10(B) and 10(C);
Sheet 9, replace FIG. 11 with attached FIGs. 11(A), 11(B), 11(C) and 11(D);
Sheet 10, replace FIG. 12 with attached FIGs. 12(A), 12(B), 12(C), 12(D) and 12(E); and
Sheet 11, replace FIG. 13 with attached FIGs. 13(A) and 13(B).

Column 3,
Line 52, "loss)." should read -- loss. --; and
Line 67, "chambers,;" should read -- chamber, --.

Column 4,
Line 31, "loss)," should read -- loss, --.

Column 5,
Lines 15 and 65, "loss)." should read -- loss. --

Column 6,
Lines 54, 57, 61 and 66, "a" should be deleted; and "view" should read -- views --.

Column 7,
Line 4, "a" should be deleted; and "view" should read -- views --;
Line 64, "proportional" should read -- proportion --; and
Line 66, "FIGS. 13, (A) and (B)" should read -- FIGS. 13(A) and 13(B) --.

Figure 13B:
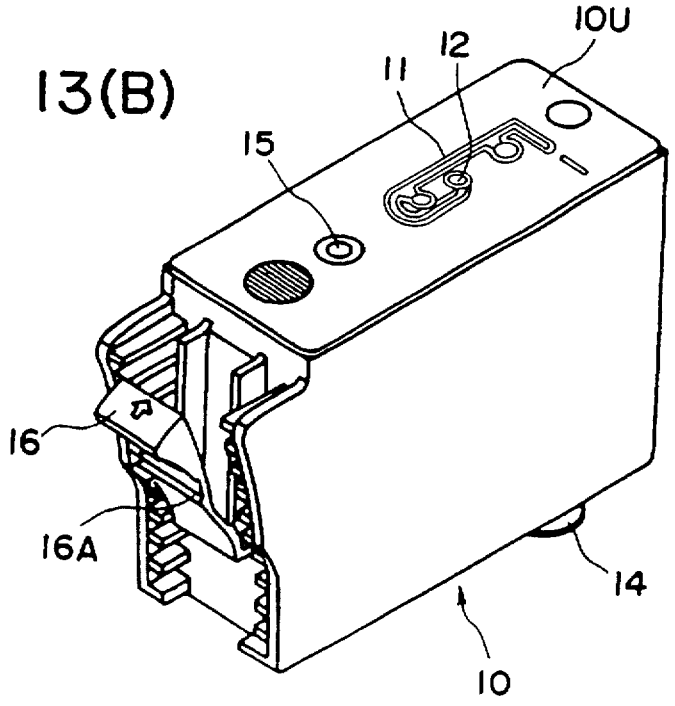

Column 8,
Line 10, "FIG. 13, (B)" should read -- FIG. 13(B) --; and
Line 34, "with" should read -- to --.

Column 9,
Line 39, "stated" should read -- state --; and
Line 66, "larger" should read -- large --.

UNITED STATES PATENT AND TRADEMARK OFFICE

CERTIFICATE OF CORRECTION

PATENT NO. : 6,145,972
DATED : November 14, 2000
INVENTOR(S) : Udagawa et al.

It is certified that error appears in the above-identified patent and that said Letters Patent is hereby corrected as shown below:

Column 10,
Line 5, "is" should read -- be --; and
Line 26, "level(gas-liquid" should read -- level (gas-liquid --.

Column 11,
Line 5, "produces" should read -- produce --.

Column 12,
Line 35, "is" should read -- be --;
Line 51, "position # (level)" should read -- position (level) --; and
Line 53, "show" should read -- shows --.

Column 13,
Line 7, "compression(volume" should read -- compression (volume --.

Column 14,
Line 20, "a" should be deleted;
Line 50, "FIG. 5, (B)" should read -- FIG. 5(B) --; and
Line 62, "FIG. 5, (C)." should read -- FIG. 5(C). --.

Column 15,
Line 44, "is" should read -- be --; and
Line 49, "apparatus # (print" should read -- apparatus (print --.

Column 16,
Line 40, "$\theta$ x(Hs-HP-$\delta$h)" should read -- $\Gamma$x(Hs-Hp-$\delta$h) --;
Line 56, "satisfy" should read -- satisfies --; and
Line 63, "$1/\cos\theta x\phi g/\theta x(H+hm)<L/S\leq 1/\cos\theta x\phi g/\theta x(Hs-Hp-\delta h)$" should read -- $1/\cos\theta x\phi g/\Gamma x(H+hm)<L/S\leq 1/\cos\theta x\phi g/\Gamma x(Hs-Hp-\delta h)$ --.

Column 17,
Line 4, "length # (the" should read -- length (the --;
Line 15, "length(the" should read -- length (the --; and
Line 37, "is" (second occurrence) should read -- be --.

UNITED STATES PATENT AND TRADEMARK OFFICE

CERTIFICATE OF CORRECTION

PATENT NO. : 6,145,972
DATED : November 14, 2000
INVENTOR(S) : Udagawa et al.

It is certified that error appears in the above-identified patent and that said Letters Patent is hereby corrected as shown below:

Column 18,
Line 31, "9(A)," should read -- 9(B), --;
Line 48, "the" should read -- too much of the --; and
Line 49, "too much extent" should be deleted.

Column 19,
Line 7, "$|h| + |\delta h x l\ell_1| < |Hs| - |Hpa|$" should read -- $|h| + |\delta h' x \ell_1| < |Hs| - |Hpa|$ --;
Line 32, "distanced" should read -- distance $l_1$ --;
Line 37, "$l_1$<(Hs-Hpa-h)/δh" should read -- $l_1$<(Hs-Hpa-h)/δh' --;
Line 49, "Hp" should read -- Hpa --;
Line 52, "δh is head loss" should read -- δh' is head loss per unit length --;
Line 56, "g (the dimension of δh is length)," should read -- g, --; and
Line 57, "that is, δh=δPe/ϕg, where δPe" should read -- δh'=δP/ϕg, where δP --; and "loss)." should read -- loss per unit length. --.

Column 20,
Line 33, "distance #$l_1$" should read -- distance $l_1$ --;
Line 34, "most remote" should read -- closest --;
Line 38, "$l_1$<$H_s$-$H_p$-h)/δh" should read -- $l_1$<$H_s$-$H_p$-h)/δh' --;
Line 53, "δh is head loss" should read – δh' is head loss per unit length --;
Line 57, "g (the dimension of δh is length)," should read -- g, --; and
Line 58, "that is, δh=δPe/ϕg, where δPe" should read -- δh'=δP/ϕg, where δP --; and "loss)." should read -- loss per unit length. --.

Column 21,
Line 22, "δPca>H," should read -- δPc>H, --;
Lines 31 and 33, "mmAg" should read -- mmAg. --;
Line 35, "hs=12mm." should read -- Hp=12mm. --; and "mmAg," (both occurrences) should read -- mmAq. --;
Line 36, "mmAg/mm," should read -- mmAq/mm, --; and
Line 67, "than #" should read -- than --.

Column 22,
Line 2, "than # $l_1$" should read -- than $l_1$ --;
Line 7, "which" should read -- which is --; and
Line 21, "intearal" should read -- integral --.

UNITED STATES PATENT AND TRADEMARK OFFICE

CERTIFICATE OF CORRECTION

PATENT NO. : 6,145,972
DATED : November 14, 2000
INVENTOR(S) : Udagawa et al.

It is certified that error appears in the above-identified patent and that said Letters Patent is hereby corrected as shown below:

Column 24;
Line 18, "groove" should read -- grooves --.

Column 25,
Line 29, "large" should read -- a large --; and
Line 55, "ratio" should read -- ratio of --.

Column 26,
Line 15, "chambers" should read -- chamber, and --.

Column 28,
Line 42, "chamber;" should read -- chamber; and --.

Column 29,
Line 20, "elected" should read -- ejected --.

Column 31,
Line 12, "therein;" should read -- therein; and --;
Line 26, "$l_1$<(Hs-Hpa-j)/δh" should read -- $l_1$<(Hs-Hpa-j)/δh' --;
Line 38, "Hp" should read -- Hpa --;
Line 41, "δh" should read -- δh' --;
Line 42, "loss" should read -- loss per unit length --;
Line 46, "g (the dimension of δh is length), that is," should read -- g, --;
Line 47, "δh=δPe/ϕg, where δPe is the pressure loss." should read -- δh'=δP/ϕg, where δP is the pressure loss per unit length. --; and
Line 61, "electing" should read -- ejecting --.

Column 32,
Line 17, "chamber," should read -- chamber; and --;
Line 31, "$l_1$<(Hs-Hp-j)/δh" should read -- $l_1$<(Hs-Hp j)/ δh' --;
Line 48, "loss" should read -- loss per unit length --;
Line 52, "g (the dimension of δh is length)," should read -- g, --;
Line 53, "δh=δPe/ϕg, where δPe is the pressure loss." should read -- δh'=δP/ϕg, where δP is the pressure loss per unit length. --; and
Line 64, "electing" should read -- ejecting --.

UNITED STATES PATENT AND TRADEMARK OFFICE

CERTIFICATE OF CORRECTION

PATENT NO. : 6,145,972
DATED : November 14, 2000
INVENTOR(S) : Udagawa et al.

It is certified that error appears in the above-identified patent and that said Letters Patent is hereby corrected as shown below:

Column 34,
Line 3, "chamber;" should read -- chamber; and --.

Signed and Sealed this

Ninth Day of April, 2002

*Attest:*

*Attesting Officer*

JAMES E. ROGAN
*Director of the United States Patent and Trademark Office*